US010325704B2

(12) United States Patent
Sakuma et al.

(10) Patent No.: US 10,325,704 B2
(45) Date of Patent: Jun. 18, 2019

(54) RARE EARTH MAGNET

(71) Applicant: TOYOTA JIDOSHA KABUSHIKI KAISHA, Toyota-shi, Aichi-ken (JP)

(72) Inventors: Noritsugu Sakuma, Mishima (JP); Akira Kato, Mishima (JP); Masao Yano, Sunto-gun (JP); Shunji Suzuki, Iwata (JP); Kurima Kobayashi, Fukuroi (JP)

(73) Assignee: TOYOTA JIDOSHA KABUSHIKI KAISHA, Toyota-shi, Aichi-ken (JP)

( * ) Notice: Subject to any disclaimer, the term of this patent is extended or adjusted under 35 U.S.C. 154(b) by 384 days.

(21) Appl. No.: 15/380,079

(22) Filed: Dec. 15, 2016

(65) Prior Publication Data

US 2017/0178772 A1 Jun. 22, 2017

(30) Foreign Application Priority Data

Dec. 18, 2015 (JP) ..... 2015-247317

(51) Int. Cl.

| | |
|---|---|
| ***H01F 1/053*** | (2006.01) |
| ***C22C 38/00*** | (2006.01) |
| ***C22C 38/10*** | (2006.01) |
| ***C22C 38/12*** | (2006.01) |
| ***C22C 38/14*** | (2006.01) |
| ***H01F 1/055*** | (2006.01) |

(52) U.S. Cl.

CPC ..... *H01F 1/053* (2013.01); *C22C 38/005* (2013.01); *C22C 38/10* (2013.01); *C22C 38/12* (2013.01); *C22C 38/14* (2013.01); *H01F 1/0557* (2013.01)

(58) Field of Classification Search

CPC ..... C22C 38/00; C22C 38/005; C22C 38/10; C22C 38/12; C22C 38/14

See application file for complete search history.

(56) References Cited

U.S. PATENT DOCUMENTS 4,971,637 A * 11/1990 Ohashi ..... H01F 1/055 148/301
6,511,552 B1 * 1/2003 Makita ..... H01F 1/055 148/301

(Continued)

FOREIGN PATENT DOCUMENTS

CN 104916382 A 9/2015
JP 2001-189206 A 7/2001

OTHER PUBLICATIONS

Thaddeus B. Massalski, "Binary Alloy Phase Diagrams", II Ed, Dec. 1990, pp. 1479-1480.

(Continued)

*Primary Examiner* — Alexandra M Moore
(74) *Attorney, Agent, or Firm* — Sughrue Mion, PLLC

(57) ABSTRACT

A rare earth magnet having a main phase and a sub-phase, wherein the main phase has a $ThMn_{12}$-type crystal structure; the sub-phase contains at least any one of an $Sm_5Fe_{17}$-based phase, an $SmCo_5$-based phase, an $Sm_2O_3$-based phase, and an $Sm_7Cu_3$-based phase; assuming that the volume of the rare earth magnet is 100%, the volume fraction of the sub-phase is from 2.3 to 9.5% and the volume fraction of an α-Fe phase is 9.0% or less; and the density of the rare earth magnet is 7.0 g/cm$^3$ or more.

9 Claims, 6 Drawing Sheets

(56) References Cited

U.S. PATENT DOCUMENTS

| | | | |
|---|---|---|---|
| 2001/0020495 | A1 | 9/2001 | Mei et al. |
| 2015/0262740 | A1 | 9/2015 | Fujiwara et al. |

OTHER PUBLICATIONS

Ying-Chang Yang, et al., "Magnetic and crystallographic properties of novel Fe-rich rare-earth nitrides of the type RTiFe11N1-δ (invited)", Journal of Applied Physics, 1991, pp. 6001-6005, vol. 70, No. 10.
Y. Wang, et al., "Magnetic and structural studies in Sm—Fe—Ti magnets", Journal of Applied Physics, 1990, pp. 4954-4956, vol. 67, No. 9.

* cited by examiner

RARE EARTH MAGNET

TECHNICAL FIELD

The present invention relates to a rare earth magnet, more specifically, a rare earth magnet in which the main phase has a $ThMn_{12}$-type crystal structure.

BACKGROUND ART

The application of a permanent magnet has extended to a wide range of fields, such as electronics, information and communication, medical treatment, machine tool, and industrial and automotive motors. In addition, with a growing demand for reduction in carbon dioxide emissions, expectations for development of a permanent magnet with higher properties are recently increasing in terms of, e.g., widespread use of hybrid cars, energy saving in the industrial field, and enhancement of power generation efficiency.

An Nd—Fe—B-based magnet dominating the market at present as a high-performance magnet is recently expanding its application to an automobile, an elevator, a component for wind-power generation, etc. from the application to a voice coil motor (VCM) and a nuclear-magnetic resonance imaging system (MRI) at an early stage of development.

With respect to the motor that is a principal application of a permanent magnet, an Nd—Fe—B-based magnet is used for motors having a wide range of output powers from several W to several kW. Among these motors, an automotive motor is used in an environment at a high temperature of a hundred and several tens of ° C., and the motor itself generates heat due to high-load rotation. Accordingly, a magnet used in an automotive motor is required to reduce deterioration of the magnetic properties at a high temperature.

As to the Nd—Fe—B-based magnet, magnetization and coercivity are easily deteriorated due to an increase in the temperature of the magnet. In order to ensure magnetic properties, particularly, coercivity of the Nd—Fe—B-based magnet at a high temperature, Dy is often added to an Nd—Fe—B-based magnet. However, since Dy is produced in limited areas, the element is not easily ensured in recent years, and the price thereof also starts rising.

For this reason, instead of an Nd—Fe—B-based magnet, studies are being made on a rare earth magnet excellent in the magnetic properties at a high temperature.

For example, Patent Document 1 discloses a rare earth magnet having a main phase with an $ThMn_{12}$-type crystal structure and a non-magnetic grain boundary phase such as $SmCu_4$, $SmFe_2Si_2$ and ZrB.

RELATED ART

Patent Document

[Patent Document 1] Japanese Unexamined Patent Publication) No. 2001-189206

SUMMARY OF THE INVENTION

Problems to be Solved by the Invention

In both the rare earth magnet disclosed in Patent Document 1 and the Nd—Fe—B-based magnet, the main phase as a magnetic phase is surrounded by a grain boundary phase as a non-magnetic phase, whereby magnetization inversion is prevented from propagating to the periphery, and the coercivity is increased. However, the present inventors have found a problem that in both of these magnets, the magnetization and coercivity at a high temperature are still insufficient.

The present invention has been made to solve the problem above, and an object of the present invention is to provide a rare earth magnet excellent in the magnetization and coercivity at a high temperature as well as at normal temperature. The normal temperature as used herein means a temperature of 20 to 30° C., and the high temperature means a temperature of 120 to 200° C.

Means to Solve the Problems

As a result of many intensive studies to attain the above-described object, the present inventors have accomplished the present invention. The gist thereof is as follows.

<1> A rare earth magnet comprising a main phase and a sub-phase, wherein the main phase has a $ThMn_{12}$-type crystal structure, wherein the sub-phase contains at least any one of an $Sm_5Fe_{17}$-based phase, an $SmCo_5$-based phase, an $Sm_2O_3$-based phase, and an $Sm_7Cu_3$-based phase, wherein the volume fraction of the sub-phase is from 2.3 to 9.5% and the volume fraction of an α-Fe phase is 9.0% or less, when the volume of the rare earth magnet is 100%, and wherein the density of the rare earth magnet is 7.0 g/cm$^3$ or more.

<2> The rare earth magnet according to item <1>, wherein part of Fe of the $Sm_5Fe_{17}$-based phase is replaced by Ti.

<3> The rare earth magnet according to item <2>, wherein the $Sm_5Fe_{17}$-based phase contains an $Sm_5(Fe_{0.95}Ti_{0.05})_{17}$ phase.

<4> The rare earth magnet according to any one of <1> to <3>, wherein part of Co of the $SmCo_5$-based phase is replaced by Cu <5> The rare earth magnet according to item <4>, wherein the $SmCo_5$-based phase contains an $Sm(Co_{0.5}Cu_{0.2})_5$ phase.

<6> The rare earth magnet according to any one of <1> to <5>, wherein the composition of the main phase is represented by the formula:

$$(R^1_{(1-x)}R^2_x)_a(Fe_{(1-y)}Co_y)_bT_cM_d$$

(wherein $R^1$ is one or more rare earth elements selected from the group consisting of Sm, Pm, Er, Tm and Yb, $R^2$ is one or more elements selected from the group consisting of Zr, La, Ce, Pr, Nd, Eu, Gd, Tb, Dy, Ho and Lu, T is one or more elements selected from the group consisting of Ti, V, Mo, Si, Al, Cr and W, M is one or more elements selected from the group consisting of Cu, Ga, Ag and Au, and unavoidable impurity elements, $0 \le x \le 0.5$, $0 \le y \le 0.8$, $4.0 \le a \le 9.0$, $b = 100 - a - c - d$, $3.0 \le c \le 7.0$, and $0 \le d \le 3.0$).

<7> The rare earth magnet according to any one of <1> to <6>, wherein the $Sm_5Fe_{17}$-phase, the $SmCo_5$-phase, the $Sm_2O_3$-phase, and the $Sm_7Cu_3$-phase contain an $Sm_5Fe_{17}$ phase, an $SmCo_5$ phase, an $Sm_2O_3$ phase, and an $Sm_7Cu_3$ phase, respectively.

<8> The rare earth magnet according to item <7>, wherein the $Sm_7Cu_3$-based phase contains a phase having mixed therein an Sm phase and an SmCu phase in a ratio of 3:4.

<9> The rare earth magnet according to item <8>, wherein the Sm phase contains a crystal phase and an amorphous Sm phase.

Effects of the Invention

According to the present invention, a rare earth magnet excellent in the magnetization and coercivity at a high temperature as well as at normal temperature can be provided.

BRIEF DESCRIPTION OF THE DRAWINGS

FIG. 4 A graph illustrating the relationship of iHc and Br at 25° C. and 160° C. in rare earth magnets of Examples 1a to 11a and Comparative Examples 51a to 56a.

MODE FOR CARRYING OUT THE INVENTION

The embodiment of the rare earth magnet according to the present invention is described in detail below. The present invention is not limited to the following embodiment.

Figure 1A:
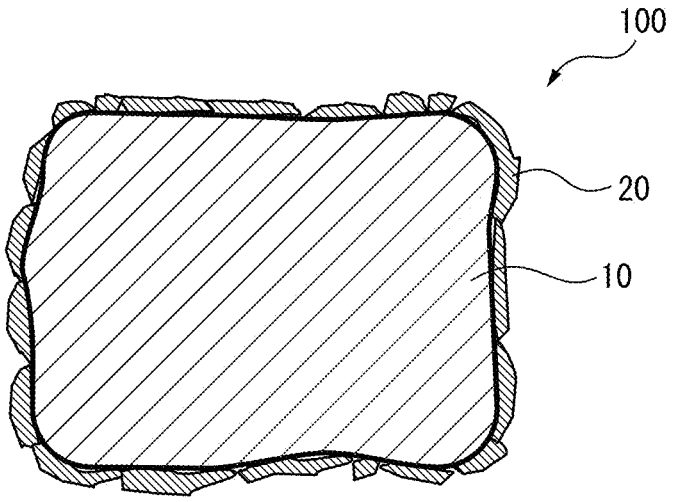
FIG. 1A A cross-sectional view schematically illustrating part of the microstructure of the rare earth magnet of the present invention.

FIG. 1A is a cross-sectional view schematically illustrating part of the microstructure of the rare earth magnet of the present invention. As illustrated in FIG. 1A, the rare earth magnet 100 of the present invention has a main phase 10 and a sub-phase 20. The rare earth magnet 100 has a plurality of such main phases 10 and sub-phases 20, and a part thereof is illustrated in FIG. 1A.

(Main Phase)

The main phase 10 has a $ThMn_{12}$-type crystal structure. As illustrated in FIG. 1, the main phase 10 is surrounded by the sub-phase 20.

The composition of the main phase 10 is not particularly limited as long as the main phase 10 has a $ThMn_{12}$-type crystal structure and has a composition of a magnetic phase of a rare earth magnet. The composition includes, for example, $SmFe_{11}Ti$, $SmFe_{10}Mo_2$, and $NdFe_{11}TiN$. $SmFe_{11}Ti$ and $SmFe_{10}Mo_2$ are preferred. Since the rare earth magnet 100 of the present invention is often produced through a heating step, decomposition of the main phase 10 during production of the rare earth magnet 100 less easily occur in $SmFe_{11}Ti$ and $SmFe_{10}Mo_2$ than in $NdFe_{11}TiN$, etc. having N.

A preferable composition of the main phase 10 is represented by the formula $(R^1_{(1-x)}R^2_x)_a(Fe_{(1-y)}Co_y)_bT_cM_d$. In the following, $R^1$, $R^2$, Fe, Co, T, and M in this formula are described.

($R^1$)

$R^1$ is a rare earth element, and owing to $R^1$, the main phase 10 exhibits magnetism. In view of magnetic properties, $R^1$ is preferably one or more rare earth elements selected from the group consisting of Sm, Pm, Er, Tm, and Yb. These elements have a positive Stevens factor, and therefore the main phase 10 can be a magnetic phase having anisotropy. Among others, Sm has a large Stevens factor and when $R^1$ is Sm, the anisotropy of the main phase 10 becomes particularly strong.

($R^2$)

Part of $R^1$ may be replaced by $R^2$ whose Stevens factor is negative. $R^2$ contracts a $ThMn_{12}$-type crystal lattice of the main phase 10. By this contraction, the $ThMn_{12}$-type crystal structure can be stabilized even when the magnet is put into a high temperature state or a nitrogen atom, etc. enters the $ThMn_{12}$-type crystal structure. On the other hand, the magnetic anisotropy of the main phase 10 is weakened by $R^2$.

The replacement ratio x of $R^1$ by $R^2$ may be appropriately determined by taking into consideration the balance between stability of the $ThMn_{12}$-type crystal structure and ensuring the magnetic anisotropy of the main phase 10. In the present invention, the replacement of $R^1$ by $R^2$ is not essential. Even when the replacement ratio x by $R^2$ is 0, the $ThMn_{12}$-type crystal structure can be stabilized, for example, by adjusting the T content or applying a heat treatment. On the other hand, when the replacement ratio x is 0.5 or less, the main phase 10 is not extremely reduced in the magnetic anisotropy. The replacement ratio x is more preferably $0 \leq x \leq 0.3$.

$R^2$ includes one or more elements selected from the group consisting of Zr, La, Ce, Pr, Nd, Eu, Gd, Tb, Dy, Ho, and Lu. In the case of placing importance on the stability of the $ThMn_{12}$-type crystal structure, Zr is preferred, and in the case of placing importance on the magnetic anisotropy of the main phase 10, heavy rare earth elements, i.e., Tb, Dy and Ho, are preferred.

The total content a of $R^1$ and $R^2$ is preferably from 4.0 to 9.0 atom %. When the content a is 4.0 atom % or more, significant precipitation of α-Fe phase is not caused, so that the volume fraction of α-Fe phase can be decreased after heat treatment and the performance as a rare earth magnet can be sufficiently brought out. The content a is more preferably 7.0 atom % or more. On the other hand, when the content a is 9.0 atom % or less, the proportion of a phase having a $ThMn_{12}$-type crystal structure does not become larger than necessary. As a result, the magnetization is not reduced. The content a is more preferably 8.5 atom % or less.

(T)

T is one or more elements selected from the group consisting of Ti, V, Mo, Si, Al, Cr and W. When the T content is increased, the stability of the $ThMn_{12}$-type crystal structure is enhanced. However, as the T content is increased, the Fe content in the main phase 10 is decreased, as a result, the magnetization is lowered.

The magnetization may be enhanced by decreasing the T content but in this case, the stability of the $ThMn_{12}$-type crystal structure is deteriorated. As a result, an α-Fe phase is precipitated, and the magnetization and coercivity are reduced.

The T content c may be appropriately determined by taking into consideration the balance between stability of the $ThMn_{12}$-type crystal structure and magnetization. The T content c is preferably from 3.0 to 7.0 atom %. When the content c is 3.0 atom % or more, the stability of the $ThMn_{12}$-type crystal structure is not excessively deteriorated. The content is more preferably 4.0 atom % or more. On the other hand, when the content c is 7.0 atom % or less, the Fe content in the main phase 10 does not become excessively small, as a result, the magnetization of the rare earth magnet is not reduced. The content is more preferably 6.0 atom %.

Among Ti, V, Mo, Si, Al, Cr, and W, as for the action of stabilizing the $ThMn_{12}$-type crystal structure, Ti is strongest. In view of the balance between magnetic anisotropy and coercivity, and magnetization, T is preferably Ti. Ti can stabilize the $ThMn_{12}$-type crystal structure even when the content thereof is small. Accordingly, a decrease in the Fe content can be suppressed.

(M)

M is one or more elements selected from the group consisting of Cu, Ga, Ag and Au, and unavoidable impurity elements. These elements are a raw material and/or an element unavoidably getting mixed into the main phase 10 in the production process.

The M content d is theoretically, preferably smaller and may be 0 atom %. However, since use of a raw material with an excessively high purity leads to a rise in the production cost, the M content d is preferably 0.1 atom % or more. On the other hand, when the M content d is 3.0 atom % or less, the reduction in performance is at a practically tolerable level. The M content d is more preferably 1.0 atom % or less.

(Fe and Co)

The main phase 10 contains Fe, in addition to $R^1$, $R^2$, T and M described above. The main phase 10 exhibits magnetization due to the presence of Fe.

Part of Fe may be replaced by Co. By this replacement, an effect according to the Slater-Pauling rule is obtained, as a result, the magnetization and magnetic anisotropy are enhanced. In addition, the Curie point of the main phase 10 rises, and this also enhances the magnetization at a high temperature.

The effect according to the Slater-Pauling rule is correlated to the replacement ratio y of Fe by Co. With a replacement ratio y between 0 and 0.3, the magnetization and magnetic anisotropy at a high temperature are increased. If the replacement ratio y exceeds 0.3, the magnetization and magnetic anisotropy at a high temperature start decreasing, and when the replacement ratio y becomes 0.8, the effect of enhancing the magnetization and magnetic anisotropy at a high temperature is substantially lost. Accordingly, the replacement ratio is preferably $0 \leq y \leq 0.8$, more preferably $0 \leq y \leq 0.3$.

In the main phase 10, other than $R^1$, $R^2$, T and M, the remainder is constituted by Fe and Co. Accordingly, the content b (atom %) of Fe and Co is represented by 100–a–c–d.

(Sub-Phase)

As illustrated in FIG. 1, the sub-phase 20 surrounds the main phase 10. The sub-phase 20 contains at least any one of an $Sm_5Fe_{17}$-based phase, an $SmCo_5$-based phase, an $Sm_2O_3$-based phase, and an $Sm_7Cu_3$-based phase. Among these phases, the $Sm_5Fe_{17}$-based phase and the $SmCo_5$-based phase are a magnetic phase exhibiting higher magnetic anisotropy than the main phase 10. On the other hand, the $Sm_2O_3$-based phase and the $Sm_7Cu_3$-based phase are a non-magnetic phase.

The $Sm_5Fe_{17}$-based phase may contain not only an $Sm_5Fe_{17}$ phase but also, as long as the function of the sub-phase 20 is not inhibited, a phase in which part of Sm and Fe are replaced by another element, or a phase in which another element has entered into the $Sm_5Fe_{17}$-based phase. Similarly, the $SmCo_5$-based phase, the $Sm_2O_3$-based phase, and the $Sm_7Cu_3$-based phase may contain not only an $SmCo_5$ phase, an $Sm_2O_3$ phase, and an $Sm_7Cu_3$ phase but also a phase described above.

Figure 2:
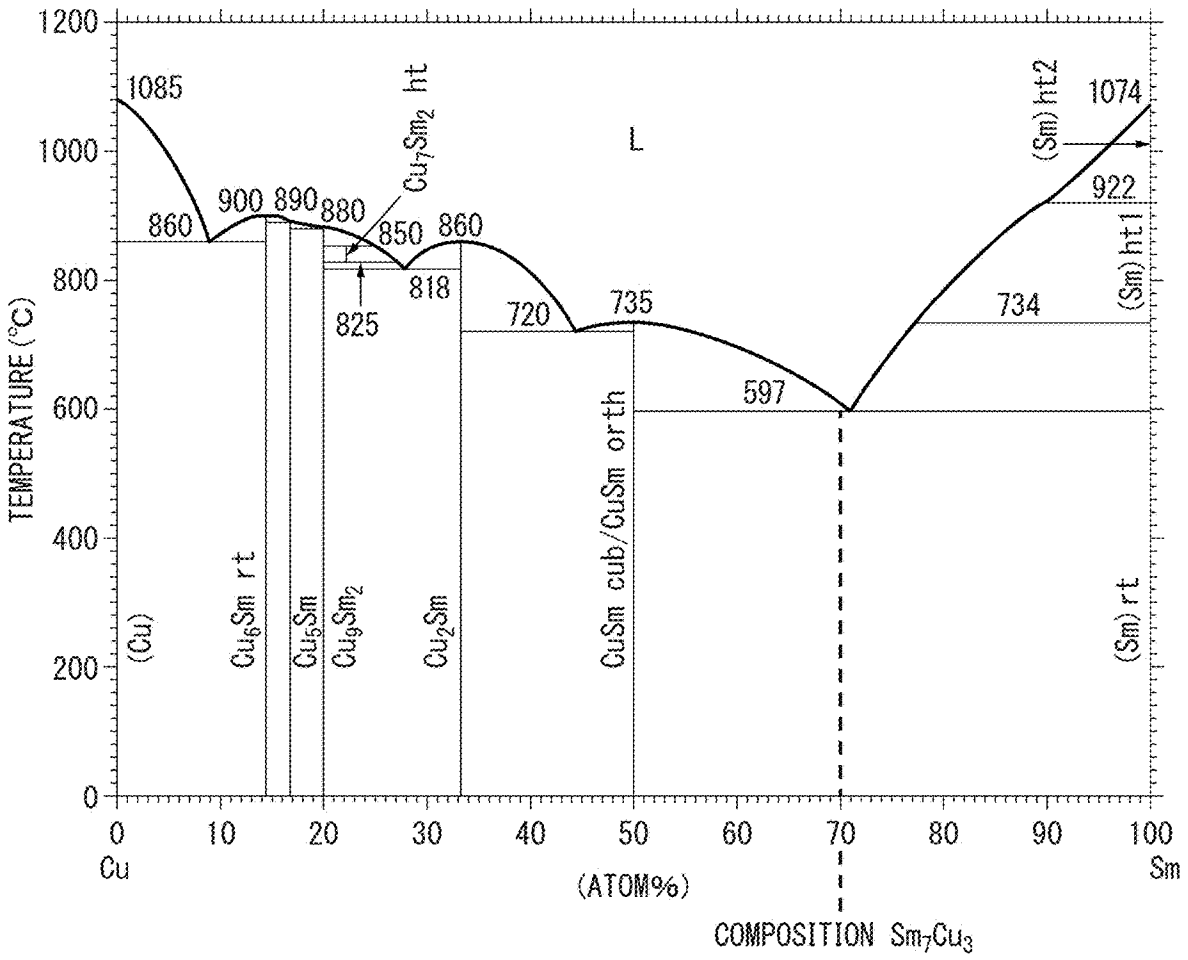
FIG. 2 An Sm—Cu-based phase diagram.

The $Sm_7Cu_3$-based phase may also be the following phase. FIG. 2 is an Sm—Cu system phase diagram (T. B. Massalski, Binary Alloy Phase Diagrams, II Ed., pp. 1479-1480). As seen from FIG. 2, an $Sm_7Cu_3$ phase is not present on the phase diagram, and therefore the $Sm_7Cu_3$ phase is a non-equilibrium phase. Accordingly, the $Sm_7Cu_3$-based phase is often present in a state of being separated into an Sm phase and an SmCu phase, and the phase diagram reveals that the ratio of these phases is (Sm phase):(SmCu phase) =4:3. That is, an Sm phase and an SmCu phase are dispersed in the ratio above to constitute an $Sm_7Cu_3$ phase.

Figure 3A:
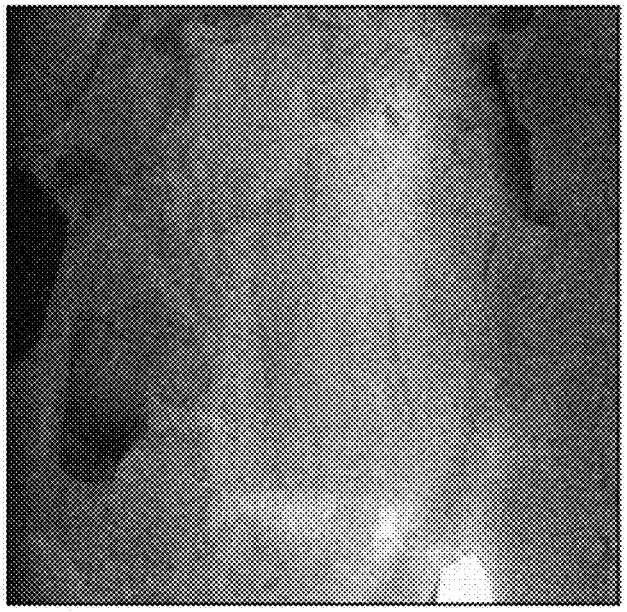
FIG. 3A A view illustrating the results from observing a microstructure of a rare earth magnet through a high-angle annular dark-field scanning transmission electron microscopy.
Figure 3B:
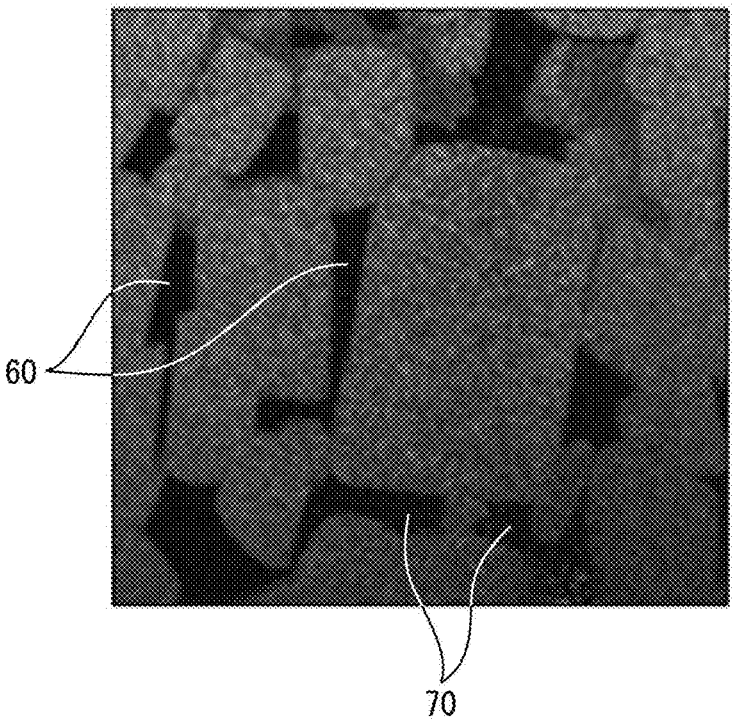
FIG. 3B A view illustrating the results of mapping of Fe in the image of FIG. 3A.
Figure 3C:
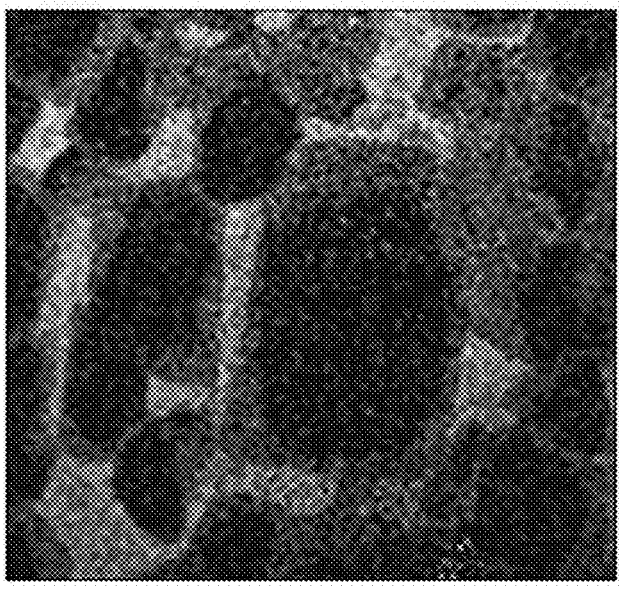
FIG. 3C A view illustrating the results of mapping of Sm in FIG. 3A.
Figure 3D:
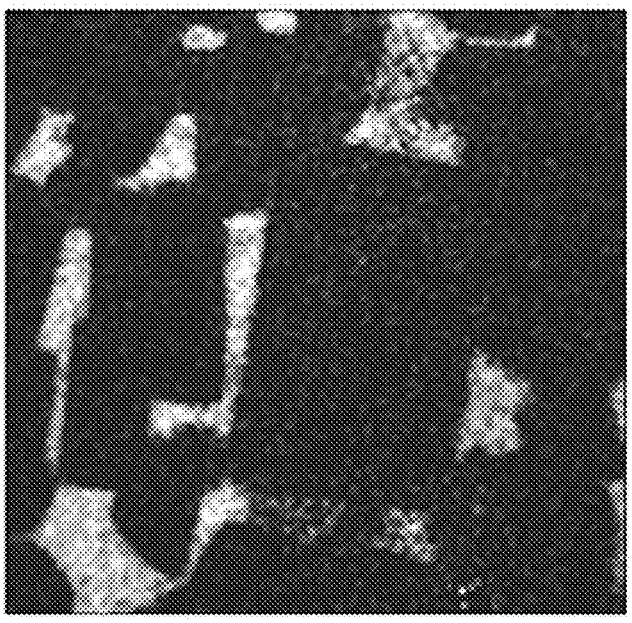
FIG. 3D A view illustrating the results of mapping of Cu in the image of FIG. 3A.

In this way, the presence of the phase in a state of being separated into an Sm phase and an SmCu phase is recognized in a rare earth magnet. For example, FIGS. 3A to 3D are views illustrating the results of mapping analysis of a microstructure of a rare earth magnet. FIG. 3A is a view illustrating the results from observing a microstructure of a rare earth magnet through a high-angle annular dark-field scanning transmission electron microscopy (HAADF-STEM: High-Angle Annular Dark Field Scanning Transmission Electron Microscopy). FIG. 3B is a view illustrating the results of mapping of Fe in the image of FIG. 3A. FIG. 3C is a view illustrating the results of mapping of Sm in FIG. 3A. FIG. 3D is a view illustrating the results of mapping of Cu in the image of FIG. 3A.

As shown in FIG. 3B, an SmCu phase 60 and an Sm phase 70 are present separately in the inside of the rare earth magnet. The same is observed also in FIGS. 3C and 3D.

In addition, since the $Sm_7Cu_3$ phase is a non-equilibrium phase, a crystalline phase and an amorphous phase are mixed in the Sm phase of the $Sm_7Cu_3$-based phase separated into an SmCu phase and an Sm phase. This indicates that the $Sm_7Cu_3$-based phase includes a case where an Sm phase (crystal phase), an amorphous Sm phase, and an SmCu phase are mixed.

The action of the sub-phase 20 is described below.

In the case where the sub-phase 20 is a magnetic phase exhibiting higher magnetic anisotropy than the main phase 10, like an $Sm_5Fe_{17}$-based phase and/or an $SmCo_5$ phase, the following effects are obtained. That is, the sub-phase 20 isolates an individual crystal grain of the main phase 10 and prevents displacement of a domain wall in the main phase 10, as a result, the magnetization and coercivity of the magnet are enhanced.

On the other hand, in the case where the sub-phase 20 is a non-magnetic phase, like an $Sm_2O_3$-based phase and an $Sm_7Cu_3$-based phase, the following effects are obtained. That is, the sub-phase 20 isolates an individual crystal grain of the main phase 10 and thereby prevents magnetization inversion of the main phase 10 from propagating to the periphery, and the magnetization and coercivity of the magnet are enhanced.

While not being bound by theory, the reason why the magnetization and coercivity at a high temperature as well as at normal temperature are enhanced by the sub-phase 20 is considered as follows.

In general, when a molten alloy is cooled and a main phase and a grain boundary phase are produced, a main phase is first produced, and a grain boundary phase is produced from the remaining melt. At the time of production of a main phase, impurities, etc. are discharged to the residual melt. Accordingly, a grain boundary produced from the residual melt allows various elements to be present in being blended together and is not thermally stable.

On the other hand, in the case of the sub-phase 20 of the rare earth magnet 100 of the present invention, a main phase 10 and a sub-phase 20 are previously prepared and thereafter, a plurality of sub-phases 20 are caused to surround the surface of the main phase 10. Accordingly, the sub-phase 20 can be a thermally stable phase, despite a non-equilibrium phase like an $Sm_5Fe_{17}$ phase, an $SmCo_5$ phase, an $Sm_2O_3$ phase, and an $Sm_7Cu_3$ phase.

As described above, these sub-phases 20 surround the main phase and thereby enhance the magnetization and coercivity of the rare earth magnet 100. In addition, since the sub-phase 20 is thermally stable, even when the temperature of the rare earth magnet 100 is high, the enhanced magnetization and coercivity are not reduced.

Figure 1B:
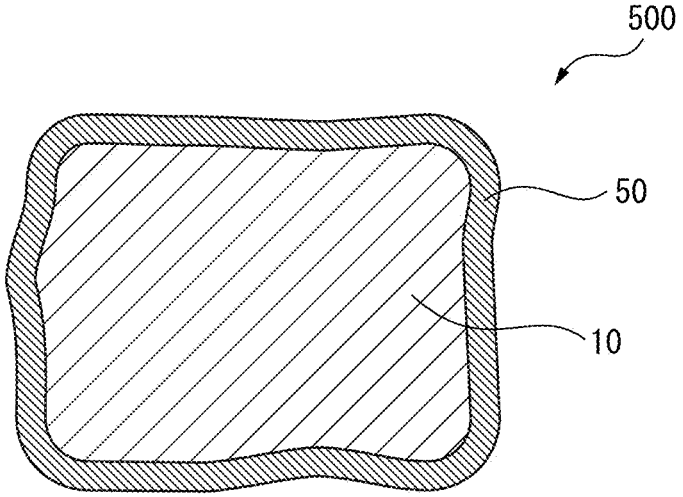
FIG. 1B A cross-sectional view schematically illustrating part of the microstructure of a conventional rare earth magnet.

The enhancement of magnetization and coercivity is suggested also on the microstructure. FIG. 1B is a cross-sectional view schematically illustrating part of the microstructure of a conventional rare earth magnet. FIG. 1B is shown for the purpose of comparison with FIG. 1A.

As shown in FIG. 1B, the conventional rare earth magnet 500 includes a main phase 10 and a grain boundary phase 50. The conventional rare earth magnet 500 has a plurality of these main phases 10 and grain boundary phases 50, and a part thereof is illustrated in FIG. 1B. Similarly to the rare earth magnet 100 of the present invention, the main phase 10 has a $ThMn_{12}$-type crystal structure also in the conventional rare earth magnet 500.

In the conventional rare earth magnet 500, as for the grain boundary phase 50, a main phase 10 is produced and a grain boundary phase 50 is produced from the residual melt (not shown). At the time of production of the grain boundary phase 50, the residual melt that is a liquid going to be solidified surrounds the surface of the main phase 10 that has become a solid by completing the solidification. Thereafter, the residual melt is solidified to form a grain boundary phase 50. Accordingly, the grain boundary phase 50 has a morphology covering the main phase 10.

On the other hand, in the case of the rare earth magnet 100 of the present invention, a main phase 10 and a sub-phase 20 are previously prepared, and a plurality of sub-phases 20 are caused to surround the surface of the main phase 10. The sub-phase 20 is finer than the main phase 10. Accordingly, in the rare earth magnet 100 of the present invention, as illustrated in FIG. 1, the main phase 10 is surrounded by an aggregate resulting from aggregation of a plurality of fine sub-phases 20.

Respective phases constituting the sub-phase 20 and having a crystal structure of an $Sm_5Fe_{17}$-based phase, an $SmCo_5$-based phase, an $Sm_2O_3$-based phase, and an $Sm_7Cu_3$-based phase are described below.

($Sm_5Fe_{17}$-Based Phase)

The $Sm_5Fe_{17}$-based phase is a non-equilibrium phase having a hexagonal crystal structure. The $Sm_5Fe_{17}$-based phase is also a magnetic phase exhibiting high magnetic anisotropy. The $Sm_5Fe_{17}$-based phase is provided as follows. Sm and Fe each weighed to afford an $Sm_5Fe_{17}$-based phase are melted to form a molten metal, and the molten metal is quenched and solidified into flakes. The flake is then pulverized into a powder. The powder may be heat-treated.

Part of Fe in the $Sm_5Fe_{17}$-based phase may be replaced by Ti. Such a phase is represented by an $Sm_5(Fe_{(1-p)}Ti_p)_{17}$ phase. When p is from 0 to 0.3, the $Sm_5(Fe_{(1-p)}Ti_p)_{17}$ phase functions as the sub-phase 20 of the rare earth magnet 100 of the present invention. The $Sm_5(Fe_{(1-p)}Ti_p)_{17}$ phase may be provided not only by the above-described melting and quenching/solidification but also by normal melting and solidification.

($SmCo_5$-Based Phase)

The $SmCo_5$-based phase is a non-equilibrium phase having a hexagonal crystal structure. The $SmCo_5$-based phase is also a magnetic phase exhibiting high magnetic anisotropy. The $SmCo_5$-based phase may be provided not only by the above-described melting and quenching/solidification but also by normal melting and solidification.

Part of Co in the $SmCo_5$-based phase may be replaced by Cu. Such a phase is represented by $Sm(Co_{(1-q)}Cu_q)_5$. When q is from 0 to 0.4, the phase represented by $Sm(Co_{(1-q)}Cu_q)_5$ functions as the sub-phase 20 of the rare earth magnet 100 of the present invention. The phase represented by $Sm(Co_{(1-q)}Cu_q)_5$ may be provided not only by the above-described melting and quenching/solidification but also by normal melting and solidification.

($Sm_2O_3$-Based Phase)

As long as the $Sm_2O_3$-based phase is a metal oxide phase functioning as the sub-phase 20 of the rare earth magnet 100 of the present invention, the method of providing the phase is not particularly limited. For example, the $Sm_2O_3$-based phase is provided by oxidizing Sm or an Sm alloy. Alternatively, the $Sm_2O_3$-based phase may be provided secondarily at the time of production of an Sm compound.

($Sm_7Cu_3$-Based Phase)

The $Sm_7Cu_3$-based phase is a non-magnetic phase. The $Sm_7Cu_3$-based phase functions as the sub-phase 20 of the rare earth magnet 100 of the present invention. The $Sm_7Cu_3$-based phase may be provided not only by the above-described melting and quenching/solidification but also by normal melting and solidification.

(Volume Fraction of Sub-Phase)

When the volume of the rare earth magnet 100 is 100%, the volume fraction of the sub-phase 20 is from 2.3 to 9.5%. The volume fraction of the sub-phase 20 is measured by the method described in Examples.

In the case where the sub-phase 20 is a magnetic phase, when the volume fraction of the sub-phase 20 is 2.3% or more, the sub-phase 20 isolates an individual crystal grain of the main phase 10 and prevents displacement of a domain wall in the main phase 10, as a result, the magnetization and coercivity of the magnet are enhanced. The volume fraction of the sub-phase 20 is preferably 3.0% or more. On the other hand, in the case where the sub-phase 20 is a magnetic phase, when the volume fraction of the sub-phase 20 is 9.5% or less, the sub-phase 20 is prevented from having an excessively large thickness and does not inhibit the movement of a domain wall. The volume fraction of the sub-phase 20 is preferably 8.0% or less, more preferably 7.0% or less.

In view of isolation of an individual crystal grain of the main phase 10 and displacement of a domain wall, the thickness of the sub-phase 20 is preferably from 1 nm to 3 μm. When the thickness of the sub-phase 20 is 1 nm or more, the action of the sub-phase 20 isolating an individual crystal grain of the main phase 10 becomes more distinct. The thickness is more preferably 0.2 μm or more. On the other hand, when the thickness of the sub-phase 20 is 3 μm or less, the displacement of a domain wall is not inhibited significantly.

In the case where the sub-phase 20 is a non-magnetic phase, when the volume fraction of the sub-phase 20 is 2.3% or more, the sub-phase 20 isolates an individual crystal grain of the main phase 10 and thereby prevents magnetization inversion of the main phase 10 from propagating to the periphery, so that the magnetization and coercivity of the magnet can be enhanced. The volume fraction of the sub-phase 20 is preferably 3.0% or more. On the other hand, in the case where the sub-phase 20 is a non-magnetic phase, when the volume fraction of the sub-phase 20 is 9.5% or less, the magnetization of the rare earth magnet 100 is not reduced. The volume fraction of the sub-phase 20 is preferably 8.0% or less, more preferably 7.0% or less.

(Volume Fraction of α-Fe Phase)

When the volume of the rare earth magnet 100 is 100%, the volume fraction of an α-Fe phase is from 0 to 9%. The α-Fe phase is principally present in the main phase 10 and is sometimes present in a small amount also in the sub-phase 20. When the α-Fe phase is present in the rare earth magnet 100, the magnetic anisotropy is reduced and as a result, the magnetization is lowered. In addition, the coercivity is also reduced. Accordingly, the volume fraction of the α-Fe phase is ideally as low as possible.

In the case where the main phase 10 contains a large amount of T, the α-Fe phase is easily present in the main phase 10. Even in such a case, when the main phase 10 is provided by extreme quenching, the volume fraction of the α-Fe phase can be decreased. However, since extreme quenching leads to a rise in the production cost, the volume fraction of the α-Fe phase is preferably 2.0% or more. On the other hand, when the volume fraction of the α-Fe phase is 9.0% or less, the reduction in magnetization and coercivity is kept at a practically tolerable level. The volume fraction of the α-Fe phase is preferably 7.0% or less, more preferably 5.0% or less.

The α-Fe phase is measured by the method described in Examples. When the α-Fe phase is present in the main phase 10, the volume fraction of the main phase 10 excludes the volume fraction of the α-Fe phase. In the case where the α-Fe phase is present in the sub-phase 20, the volume fraction of the sub-phase 20 excludes the volume fraction of the α-Fe phase.

As long as the magnetic properties of the rare earth magnet 100 are not affected, the rare earth magnet 100 may contain a phase other than the phases described above. At this time, when the volume of the rare earth magnet 100 is 100%, the total of respective volume fractions of the sub-phase 20, the α-Fe phase and the remainder is 100%. The remainder consists of the main phase 10, a phase not affecting the magnetic properties of the rare earth magnet 100, and a phase unavoidably contained. The volume fraction of each of the main phase 10, the sub-phase 20 and the α-Fe phase is measured by the method described in Examples. Accordingly, the total (percentage) of a phase not affecting the magnetic properties of the rare earth magnet 100 and a phase unavoidably contained is determined by subtracting the total of respective volume fractions (percentage) of the main phase 10, the sub-phase 20 and the α-Fe phase from 100%.

(Density of Rare Earth Magnet)

The density of the rare earth magnet 100 is 7.0 g/cm$^3$ or more. The density of the rare earth magnet 100 is measured by the method described in Examples.

As for the sub-phase 20 of the rare earth magnet 100 of the present invention, a main phase 10 and a sub-phase 20 are previously prepared and thereafter, a plurality of sub-phases 20 are caused to surround the surface of the main phase 10. At this time, the plurality of sub-phases 20 are caused to surround the surface of the main phase 10 as closely together as possible, then, the magnetization is enhanced.

When the density of the rare earth magnet 100 is 7.0 g/cm$^3$ or more, magnetization is not significantly reduced. The density is preferably 7.5 g/cm$^3$ or more. On the other hand, when the density of the rare earth magnet 100 is 7.9 g/cm$^3$ or less, the production cost does not rise. At the time of surrounding of the surface of the main phase 10 by a plurality of sub-phases 20, it is ideal that absolutely no gap is present between these phases. However, when surrounding is performed to produce absolutely no gap between these phases, the production cost rises due to decrease in the yield, etc. When the density of the rare earth magnet 100 is 7.9 g/cm$^3$, this is substantially the same as an absolute absence of a gap between those phases. The density of the rare earth magnet 100 may be 7.7 g/cm$^3$ or less.

(Production Method)

The production method of the rare earth magnet 100 of the present invention is described below. As long as the rare earth magnet 100 satisfies the requirements described hereinabove, the production method thereof is not limited to the method described below.

First Embodiment

The first embodiment of the production method of the rare earth magnet 100 of the present invention comprises:

producing a first alloy having a composition working out to the main phase 10, and pulverizing the first alloy to obtain a first alloy powder, producing a second alloy having a composition working out to the sub-phase 20, and pulverizing the second alloy to obtain a second alloy powder, mixing the first alloy powder and the second alloy powder to obtain a mixture, and powder-compacting the mixture to obtain a green compact, and sintering the green compact to obtain a sintered body.

Each step is described below.

(First Alloy Producing Step)

As raw materials, a pure metal of each element or a master alloy containing respective elements is weighed to provide the composition of the main phase 10. At this time, the raw materials are weighed in anticipation of a change in the composition due to, e.g., evaporation of a specific substance in the subsequent step. The raw materials weighed are melted to obtain a molten metal, and the molten metal is cooled to produce a first alloy.

The melting method is not particularly limited as long as pure metals or a master alloy can be melted, and includes, for example, high frequency melting.

As for the cooling of the molten metal, from the viewpoint of suppressing production of an α-Fe phase and obtaining a uniform and fine microstructure, the molten metal is preferably quenched. Quenching means to perform cooling at a rate of $1\times10^2$ to $1\times10^7$ K/sec. By achieving a uniform and fine microstructure, when the first alloy is pulverized, variation in the microstructure in individual particles of the powder can be suppressed.

The quenching method includes, for example, strip casting and melt spinning. In the case where the main phase 10 has a composition hardly capable of producing an α-Fe phase, the cooling of the molten metal may be, for example, a method of casting the molten metal in a die (permanent mold casting method). In the case of using strip casting or melt spinning, a flake having a thickness of several tens to several hundreds of μm is obtained as the first alloy. In the case of using the permanent mold casting method, an ingot is obtained as the first alloy.

(Second Alloy Producing Step)

This step is the same as the first alloy producing step except for melting pure metals of respective elements or a master alloy containing respective elements to obtain a molten metal and provide the composition of the sub-phase 20.

(First Alloy Powder Producing Step)

The first alloy is pulverized to obtain a first alloy powder of a few μm to tens of μm. The pulverizing method includes a method using a jet mill, a ball mill, a jaw crusher, or a hammer mill. In the jet mill, a nitrogen steam is used in general.

The first alloy may be hydrogen-pulverized. The hydrogen pulverization method includes a method of treating the first alloy at room temperature to 500° C. under normal pressure to several atmospheres to allow the first alloy to store hydrogen and pulverizing the alloy.

Before pulverizing the first alloy, the first alloy is preferably subjected to a solution treatment at 900 to 1,200° C. The solution treatment makes the microstructure of the first alloy before pulverization uniform, and variation in the microstructure in individual particle of first alloy powders after pulverization can be reduced.

(Second Alloy Powder Producing Step)

The second alloy powder producing step is the same as the first alloy powder producing step. The first alloy powder producing step and the second alloy powder producing step may be performed separately, or after weighing a necessary amount of each of the first alloy and the second alloy, the first ally and the second alloy may be pulverized together. By pulverizing the powders together, the first alloy powder and the second alloy powder are easily mutually dispersed.

In the case where the first alloy and the second alloy are hydrogen-pulverized, at the time of sintering of a green compact of these powders, hydrogen is released from the green compact in the temperature rise process of sintering, and a hydrocarbon-based lubricant added during powder compacting is readily removed. As a result, impurities such as carbon and oxygen can be prevented from remaining in the obtained sintered body. In the case where either the first alloy powder or the second alloy powder is produced by hydrogen pulverization, remaining of impurities can be suppressed to the extent of hydrogen pulverization of either powder.

(Powder Compacting Step)

A necessary amount of each of the first alloy powder and the second alloy powder is weighed, and from 0.01 to 0.5 mass % of a lubricant is added to the powders and mixed to obtain a mixture. The lubricant includes, for example, stearic acid, calcium stearate, oleic acid, and caprylic acid. In the case of pulverizing the first alloy and the second alloy together, a lubricant is added to the powders pulverized together to obtain a mixture.

The mixture is filled into a die and powder-compacted to obtain a green compact. A DC magnetic field of 1 to 2 T or a pulsed magnetic field of 3 to 5 T is applied to the die, whereby magnetic orientation can be imparted to the green compact.

(Sintering Step)

The green compact is sintered at 950 to 1,200° C. during 0.1 to 12 hours in an inert atmosphere such as argon gas or in vacuum to obtain a sintered body.

At the time of heating-up the green compact for sintering, the green compact is preferably heated-up in a temperature region of 300 to 500° C. in vacuum and held in this temperature region during 1 to 2 hours. By performing the heating-up in this way, the lubricant added in the powder compacting step can be removed.

In the case where Sm is selected for $R^1$ of the main phase 10, at around 1,000° C., the green compact starts shrinking and evaporation of Sm proceeds. Accordingly, in order to suppress evaporation of Sm, sintering of the green compact at around 1,000° C. is preferably performed in an inert gas atmosphere. In addition, the Sm content in the first alloy powder is preferably set to be slightly larger than the target content in the main phase 10 in anticipation of evaporation of Sm.

In the case of performing pressure sintering, the green compact is sintered while applying a hydrostatic pressure of 40 to 1,000 MPa thereto. In this case, the pressure atmosphere, the sintering temperature and the sintering time are respectively an argon atmosphere, from 600 to 1,000° C., and from 0.01 to 1 hour. Compared with pressureless sintering, in the pressure sintering, the sintering can be completed at a low temperature in a short time, whereby decomposition of the sub-phase 20 and/or coarsening of the crystal grain can be prevented.

After sintering, the sintered body may be heat-treated in an inert gas such as argon gas or in vacuum. The heat treatment temperature may be appropriately determined in a range of 500 to 1,000° C. according to the composition of the sub-phase 20. The heat treatment time may be appropriately determined in a range of 2 to 48 hours according to the volume fraction of the sub-phase 20.

For example, in the case where the sub-phase 20 is an $Sm_7Cu_3$-based phase, since the melting point of $Sm_7Cu_3$ is low, the heat treatment is preferably performed at 500 to 800° C. for 1 to 12 hours. In the case where the sub-phase 20 is an $Sm_5Fe_{17}$-based phase and/or an $SmCo_5$-based phase, the heat treatment is preferably performed at 700 to 900° C. for 4 to 48 hours. In particular, when the sub-phase 20 is an $Sm_5Fe_{17}$-based phase, since $Sm_5Fe_{17}$ decomposes at 1,000° C. or more, it is crucial to perform the heat treatment at 900° C. or less. If the heat treatment temperature is a high temperature, the main phase 10 and/or the sub-phase 20 are coarsened.

By heat-treating the sintered body in this way after sintering, the bonding of the main phase 10 and the sub-phase 20 becomes firmer, and as a result, the magnetization and coercivity of the rare earth magnet 100 are more enhanced.

Second Embodiment

In the case where the sub-phase 20 is a metal oxide phase such as $Sm_2O_3$-based phase, an oxide powder is prepared in place of the second alloy powder of the first embodiment.

The method for preparing a metal oxide powder includes a method of oxidizing a pure metal powder of a metallic element constituting a metal oxide. It may be also possible to oxidize a powder of an alloy containing a metallic element constituting a metal oxide.

Third Embodiment

The third embodiment of the production method of the rare earth magnet 100 of the present invention comprises:

producing a first alloy having a composition working out to the main phase 10, and pulverizing the first alloy to obtain a first alloy powder, producing a second alloy having a composition working out to the sub-phase 20, and pulverizing the second alloy to obtain a second alloy powder, powder-compacting the first alloy powder to obtain a green compact, sintering the green compact to obtain a sintered body, applying the second alloy powder onto a surface of the sintered body to obtain a coated sintered body, and heating the coated sintered body to diffuse the second alloy into the grain boundary of the sintered body.

The first alloy producing step, the second alloy producing step, the first alloy powder producing step and the second alloy powder producing step of the third embodiment are the same as those in the first embodiment.

The powder compacting step of the third embodiment is the same as the powder compacting step of the first embodiment except that the first alloy powder alone is powder-compacted without mixing the first alloy powder and the second alloy powder.

The sintering step of the third embodiment is the same as the sintering step of the first embodiment except that the green compact obtained by powder-compacting the first alloy powder alone is sintered.

(Diffusing Step)

In the third embodiment, the second alloy powder is applied onto a surface of the sintered body to obtain a coated sintered body, and the coated sintered body is heated to diffuse the second alloy into the grain boundary of the sintered body. The grain boundary into which the second alloy is diffused is the sub-phase 20 of the rare earth magnet 100.

The method of applying the second alloy powder is not particularly limited as long as the second alloy can be diffused into the grain boundary of the sintered body. The method includes, for example, a method where a slurry obtained by mixing the second alloy powder with a solvent is applied onto a surface of the sintered body by a brush, etc., and a method where the second alloy powder is applied onto a surface of the sintered body by screen printing.

The solvent used at the time of production of a slurry is not particularly limited as long as it does not interfere with the magnetic properties of the rare earth magnet 100. The solvent includes, for example, silicon grease and a hydrocarbon-based solvent such as glycol.

Before applying the second alloy powder onto a surface of the sintered body, an oxide film on the surface of the sintered body is preferably removed. By this removal, the second alloy is easily diffused into the grain boundary of the sintered body. Removal of an oxide film is effective particularly when the thickness of the oxide film is 0.1 μm or more. The method of removing an oxide film includes, for example, a method of grinding the surface of the sintered body by using a grinding machine, and a method of grinding the surface of the sintered by using a sand blaster.

The coated sintered body is heated to diffuse the second alloy into the grain boundary of the sintered body. The heating atmosphere is preferably under reduced pressure or in vacuum. Because, even if an air, etc. are present between main phase particles in the sintered body before diffusion of the second alloy, when the coated sintered body is placed under reduced pressure or in vacuum, the air, etc. are removed, and it becomes easy for the second alloy to diffuse into the grain boundary.

The heating temperature may be appropriately determined in a range of 500 to 1,000° C. according to the composition of the sub-phase 20. The heating time may be appropriately determined in a range of 2 to 48 hours according to the volume fraction of the sub-phase 20.

As with the heat treatment after sintering of the first embodiment, the sintered body where the secondary alloy is diffused into the grain boundary may be further heat-treated.

Fourth Embodiment

In the case where the sub-phase 20 is a metal oxide phase such as $Sm_2O_3$-based phase, an oxide powder is prepared in place of the second alloy powder of the third embodiment.

The method of preparing a metal oxide powder includes a method of oxidizing a pure metal powder of a metallic element constituting a metal oxide. It may be also possible to oxidize a powder of an alloy containing a metallic element constituting a metal oxide.

Fifth Embodiment

In place of the diffusing step of the third embodiment, it may be also possible to insert the sintered body into a vessel filled with the second alloy powder and heat the vessel.

Sixth Embodiment

In the third embodiment, instead of producing a second alloy powder, there may be used, for example, a method of producing a second alloy plate comprising: putting the second alloy plate into contact with the sintered body, and heating and pressurizing the plate. In place of heating and pressurization, the second alloy plate may be welded to the sintered body.

EXAMPLES

The present invention is described more specifically below by referring to Examples. The present invention is not limited to the conditions used in the following Examples.

Examples 1a to 7a

In Examples 1a to 7a, a rare earth magnet 100 was prepared by a method corresponding to the first embodiment.

High-purity Sm, Fe, Ti, V and Mo were weighed in a predetermined ratio and high-frequency melted in an argon gas atmosphere, and a flake-like first alloy was prepared from the melt by using a strip casting device.

High-purity Sm, Fe and Ti were weighed in a predetermined ratio and high-frequency melted in an argon atmosphere, and a flake-like second alloy was prepared from the melt. The composition of the second alloy was set such that the composition of the sub-phase 20 of the rare earth magnet 100 becomes $Sm_5(Fe_{0.95}Ti_{0.05})_{17}$.

The first alloy and the second alloy were mixed to obtain a mass of the second alloy of 4% relative to the mass of the first alloy, and charged into a jet mill apparatus using a nitrogen stream to obtain a mixture. The size of particles constituting the mixture was about 5 μm in terms of the equivalent sphere diameter.

Subsequently, 0.05 mass % of oleic acid was added to the mixture, and the resulting mixture was filled into a die and powder-compacted to obtain a green compact. A magnetic field of 2 T was applied to the die. The compacting pressure was 120 MPa.

The green compact was sintered at 1,180° C. during 2 hours in an argon gas atmosphere to obtain a sintered body. The sintered body was cooled to room temperature and then heat-treated at 800° C. during 4 hours. The sintered body was a rectangular parallelepiped having a size of 8 mm×8 mm×5 mm.

Comparative Examples 51a to 53a

Rare earth magnets were prepared in the same manner as in Examples 1a to 7a other than the composition of the first alloy.

Comparative Example 54a

A rare earth magnet 100 was produced in the same manner as in Examples 1a to 7a except that at the time of mixing the first alloy and the second alloy, the mass of the second alloy was 0% relative to the mass of the first alloy.

Examples 8a and 9a

An Sm—Cu master alloy and an Sm—Co master alloy were weighed in a predetermined ratio and high-frequency melted in an argon atmosphere, and a flake-like second alloy was prepared from the melt. Rare earth magnets 100 were prepared in the same manner as in Examples 1a to 7a other than setting the composition of the second alloy such that the composition of the sub-phase 20 of the rare earth magnet 100 becomes $Sm(Co_{0.8}Cu_{0.2})_5$.

Comparative Example 55a

A rare earth magnet 100 was prepared in the same manner as in Examples 8a and 9a except that at the time of mixing the first alloy and the second alloy, the mass of the second alloy was 0% relative to the mass of the first alloy.

Examples 10a and 11a

Rare earth magnets 100 were prepared in the same manner as in Examples 1a to 7a other than pressure-sintering the green compact. The pressure sintering was performed in vacuum. The applied pressure was 400 MPa or 100 MPa. The sintering time was 10 minutes. At the time of pressure sintering, an Inconel-made die was used.

Comparative Example 56a

A rare earth magnet was prepared in the same manner as in Examples 10a and 11a except that the applied pressure was 0 MPa (pressureless).

Examples 1b to 7b

In Examples 1b to 7b, a rare earth magnet 100 was prepared by a method corresponding to the third embodiment or the fourth embodiment.

High-purity Sm, Zr, Fe, Co and Ti were weighed in a predetermined ratio and high-frequency melted in an argon gas atmosphere, and a flake-like first alloy was prepared from the melt by using a strip casting device. The composition of the main phase 10 of a rare earth magnet 100 obtained using this first alloy is represented by $(Sm_{0.875}Zr_{0.125})_8(Fe_{0.77}Co_{0.23})_{88}Ti_4$.

The first alloy was charged into a jet mill apparatus using a nitrogen stream to obtain a first alloy powder. The size of the first alloy powder was about 5 μm in terms of the equivalent sphere diameter.

Subsequently, 0.05 mass % of oleic acid was added to the first alloy powder, and the resulting powder was filled into a die and powder-compacted to obtain a green compact. A magnetic field of 2 T was applied to the die. The compacting pressure was 120 MPa.

The green compact was sintered at 1,180° C. during 2 hours in an argon gas atmosphere to obtain a sintered body. The sintered body was cooled to room temperature. The sintered body was a rectangular parallelepiped having a size of 8 mm×8 mm×5 mm.

High-purity Sm, Fe and Ti were weighed in a predetermined ratio and high-frequency melted in an argon atmosphere, and a flake-like second alloy was prepared from the melt. The composition of the second alloy was set such that the composition of the sub-phase 20 of the rare earth magnet 100 becomes $Sm_5(Fe_{0.95}Ti_{0.05})_{17}$.

Furthermore, an Sm—Cu master alloy and an Sm—Co master alloy were weighed in a predetermined ratio and high-frequency melted in an argon atmosphere, and a flake-like second alloy was prepared from the melt. The composition of the second alloy was set such that the composition of the sub-phase 20 of the rare earth magnet 100 becomes $Sm(Co_{0.3}Cu_{0.2})_5$ or $Sm_7Cu_3$.

Each of these second alloys was separately charged into a jet mill apparatus using a nitrogen stream to obtain a second alloy powder. The size of the second alloy powder was from 5 to 15 μm in terms of the equivalent sphere diameter.

In place of the second alloy powder, a commercially available high-purity $Sm_2O_3$ powder was prepared. The size of this oxide powder was 3 μm in terms of the equivalent sphere diameter.

Each of these second alloy powders and oxide powder was separately mixed with ethylene glycol to prepare a slurry.

The slurry was applied onto both surfaces of the sintered body polished to a size of 8 mm×8 mm×4 mm to obtain a coated sintered body. As to coating with the slurry, the sintered body was coated with the slurry from 1 to 5 times per one surface by using a screen printing method. The volume fraction of the sub-phase 20 was adjusted by the number of times of coatings.

The coated sintered body was heated at 800° C. during 8 hours in vacuum so as to cause the second alloy or oxide to penetrate into the grain boundary of the sintered body.

Comparative Example 51b

A rare earth magnet was prepared in the same manner as in Examples 1b to 7b except that the sintered body was not coated with a slurry and was heated at 800° C. during 8 hours in vacuum.

Comparative Example 52b

A rare earth magnet was prepared in the same manner as in Examples 1b to 7b except that the surfaces of the sintered body was coated with the slurry 8 times per one surface.

(Examples 1c to 4c)

In Examples 1c to 4c, a rare earth magnet 100 was prepared by a method corresponding to the third embodiment by changing the heating temperature of the coated sintered body.

High-purity Sm, Ce, Zr, Fe, Co and Ti were weighed in a predetermined ratio and high-frequency melted in an argon gas atmosphere, and a flake-like first alloy was prepared from the melt by using a strip casting device. The composition of the main phase 10 of a rare earth magnet 100 obtained using this first alloy is represented by $(Sm_{0.75}(CeZr)_{0.25})_8(Fe_{0.77}Co_{0.23})_{87}Ti_5$.

The first alloy was charged into a jet mill apparatus using a nitrogen stream to obtain a first alloy powder. The size of the first alloy powder was about 5 μm in terms of the equivalent sphere diameter.

Subsequently, 0.05 mass % of calcium stearate was added as a lubricant to the first alloy powder, and the resulting powder was filled into a die and powder-compacted to obtain a green compact. A pulsed magnetic field of 3 T was intermittently applied to the die. The compacting pressure was 150 MPa.

The green compact was heated-up to 500° C. in vacuum and then sintered at 1,150° C. during 3 hours in an argon gas atmosphere to obtain a sintered body. The sintered body was cooled to room temperature. Here, by heating-up the green compact in vacuum, separation of the lubricant could be suppressed, and by performing the sintering in an argon gas atmosphere, evaporation of Sm could be suppressed.

An Sm—Cu master alloy was weighed in a predetermined ratio and high-frequency melted in an argon atmosphere, and a flake-like second alloy was prepared from the melt. The composition of the second alloy was set such that the composition of the sub-phase 20 of the rare earth magnet 100 becomes $Sm_7Cu_3$.

The second alloy was charged into a jet mill apparatus using a nitrogen stream to obtain a second alloy powder. The size of the second alloy powder was from 5 to 15 μm in terms of the equivalent sphere diameter.

The second alloy powder was mixed with silicon grease to prepare a slurry.

The slurry was applied onto both surfaces of the sintered body polished to a size of 8 mm×8 mm×4 mm to obtain a coated sintered body. As to coating with the slurry, the slurry was applied 3 times per one surface by using a screen printing method. Consequently, the sintered body was coated with a second alloy powder corresponding to 5 mass %.

The coated sintered body was heated at 600 to 900° C. during 8 hours in a vacuum furnace so as to cause the second alloy to penetrate into the grain boundary of the sintered body. Thereafter, the coated sintered body was cooled in the furnace.

Comparative Example 51c

In Comparative Example 51c, a rare earth magnet was prepared in the same manner as in Examples 1c to 4c except that a slurry was not applied onto the sintered body and the sintered body was heated at 700° C. during 8 hours in vacuum.

Comparative Example 52c

In Comparative Example 52c, a rare earth magnet was prepared in the same manner as in Examples 1c to 4c other than changing the heating temperature to 500° C.

Examples 5c to 9c

In Examples 5c to 9c, a rare earth magnet 100 was prepared in the same manner as in Examples 1c to 4c other than setting the composition of the second alloy such that the composition of the sub-phase 20 of the rare earth magnet 100 becomes $Sm_5(Fe_{0.95}Ti_{0.05})_{17}$, and changing the heating temperature to a range of 500 to 900° C.

Comparative Example 53c

In Comparative Example 53c, a rare earth magnet was prepared in the same manner as in Examples 5c to 9c except that a slurry was not applied onto the sintered body and the sintered body was heated at 700° C. during 8 hours in vacuum.

Comparative Example 54c

In Comparative Example 54c, a rare earth magnet was prepared in the same manner as in Examples 5c to 9c other than changing the heating temperature to 1,000° C.

Examples 1D to 7d

In Examples 1d to 7d, a rare earth magnet 100 was prepared by changing the Co content in the main phase 10 by using the method corresponding to the third embodiment.

High-purity Sm, Zr, Fe, Co and Ti were weighed in a predetermined ratio and high-frequency melted in an argon gas atmosphere, and a flake-like first alloy was prepared from the melt by using a strip casting device. The composition of the main phase 10 of a rare earth magnet 100 obtained using this first alloy is represented by $(Sm_{0.875}Zr_{0.125})_8(Fe_{(1-y)}Co_y)_{88}Ti_4$, wherein the value of y is from 0 to 0.8.

The first alloy was charged into a jet mill apparatus using a nitrogen stream to obtain a first alloy powder. The size of the first alloy powder was about 5 μm in terms of the equivalent sphere diameter.

Subsequently, 0.05 mass % of oleic acid was added to the first alloy powder, and the resulting powder was filled into a die and powder-compacted to obtain a green compact. A magnetic field of 2 T was applied to the die. The compacting pressure was 120 MPa.

The green compact was heated-up to 500° C. in vacuum and then sintered at 1,150° C. during 3 hours in an argon gas atmosphere to obtain a sintered body. The sintered body was cooled to room temperature.

High-purity Sm, Fe and Ti were weighed in a predetermined ratio and high-frequency melted in an argon atmosphere, and a flake-like second alloy was prepared from the melt. The composition of the second alloy was set such that the composition of the sub-phase 20 of the rare earth magnet 100 becomes $Sm_5(Fe_{0.95}Ti_{0.05})_{17}$.

The second alloy was charged into a jet mill apparatus using a nitrogen stream to obtain a second alloy powder. The size of the second alloy powder was from 5 to 15 μm in terms of the equivalent sphere diameter.

The second alloy powder was mixed with silicon grease to prepare a slurry.

The slurry was applied onto both surfaces of the sintered body polished to a size of 8 mm×8 mm×4 mm to obtain a coated sintered body. As to coating with the slurry, the slurry was applied 3 times per one surface by using a screen printing method. Consequently, the sintered body was coated with a second alloy powder corresponding to 5 mass % relative to the entire sintered body.

The coated sintered body was heated at 1,200° C. during 8 hours in a vacuum furnace so as to cause the second alloy to penetrate into the sintered body. Thereafter, the coated sintered body was cooled in the furnace.

Reference Example 51d

As Reference Example 51d, an Nd—Fe—B-based sintered magnet with the main phase being $Nd_2Fe_{14}B$ was prepared.

(Evaluation)

Each of the rare earth magnets of Examples, Comparative Examples and Reference Example was subjected to X-ray diffraction (XRD: X Ray Diffraction) analysis, and the crystal structure of the main phase was identified from the X-ray diffraction pattern. In the case where the volume fraction of the sub-phase is from 5 to 10%, the crystal structure of the sub-phase was identified and at the same time, the volume fraction of the sub-phase was determined, from the low-intensity diffraction line of X-ray diffraction. At this time, when the total peak intensity of the X-ray diffraction pattern is 100, the proportion (percentage) of the peak intensity of the sub-phase is taken as the volume fraction of the sub-phase. In the case where the volume fraction of the sub-phase is less than 5%, due to the small volume fraction of the sub-phase, the crystal structure of the sub-phase could not be identified and the volume fraction of the sub-phase could not be determined as well, by the method above. Accordingly, when the volume fraction of the sub-phase is less than 5%, the method described below was used.

Each of the rare earth magnets of Examples, Comparative Examples and Reference Example was surface-polished, and the surface after polishing was observed for microstructure with a scanning electron microscope (SEM: Scanning Electron Microscope) and at the same time, subjected to mapping by energy-dispersive X-ray spectroscopy (EDX: Energy Dispersive X-ray Spectroscopy). The size of visual field in microstructure observation and mapping was 100×100 μm. The proportion (percentage) of the area of the main phase was determined by image analysis of the mapping results and taken as the volume fraction (percentage) of the main phase. In the case where the volume fraction of the sub-phase was less than 5%, the composition of the sub-phase was identified from the mapping results.

Furthermore, on the surface after polishing of the rare earth magnet, by performing lattice analysis of the microstructure part by a transmission electron microscope (TEM: Transmission Electron Microscope), each of the sub-phase and an α-Fe phase was identified, and the volume fraction thereof was determined.

With respect to the magnetic properties, the residual magnetic flux density Br and the intrinsic coercivity iHc were measured on each of the rare earth magnets of Examples, Comparative Examples and Reference Example by using a physical property measurement system (PPMS: Physical Property Measurement System). Both the residual magnetic flux density Br and the intrinsic coercivity iHc were measured at 25° C. and 160° C.

The density of each of the rare earth magnets of Examples, Comparative Examples and Reference Example was measured by a gas-phase substitution method (picnometer) and taken as the density of the magnet.

Evaluation results are shown in Tables 1 to 7. In Tables 1 to 7, the crystal structure, composition and volume fraction of the main phase 10, the crystal structure and volume fraction of the sub-phase 20, and the mixed amount of the second alloy powder or the converted amount of the second alloy are shown together. In addition, the volume fraction of α-Fe phase and the density of magnet are shown together.

In Tables 1 to 3, the mixed amount of alloy is a value expressing the mass of the second alloy powder mixed with the first alloy powder, as a percentage (mass %) relative to the mass of the first alloy powder.

In Tables 4 to 7, the number of times of coatings (number of times of screen printings) with slurry per one surface is shown. In addition, in Tables 4 to 7, the converted amount of alloy is also shown. The converted amount of alloy is a value where the mass of the second alloy applied onto the entire sintered body is converted into to a percentage (mass %) relative to the mass of the first alloy powder. When the entire sintered body is coated with the slurry, each surface of the sintered body is respectively coated in accordance with the number of times per one surface shown in tables 4 to 7. For example, in Example 1c of Table 5, the "converted amount of alloy is 5 mass %" means that when both surfaces of the sintered body are coated with the slurry 3 times per one surface, the mass of the second alloy powder applied onto the entire sintered body (both surfaces) is 5% relative to the mass of the first alloy powder".

TABLE 1

| | Main Phase | | | Sub-Phase | | | | | 25° C. | | 160° C. | |
|---|---|---|---|---|---|---|---|---|---|---|---|---|
| | Crystal Structure | Composition | Volume Fraction (%) | Crystal Structure | Volume Fraction (%) | Mixed Amount of Alloy (mass %) | Volume Fraction of α-Fe Phase (%) | Density of Magnet (g/cm³) | Br (kG) | iHc (kOe) | Br (kG) | iHc (kOe) |
| Example 1a | ThMn12 | Sm8Fe85Ti7 | 93.2 | Sm5(Fe0.95T0.05)17 | 3.8 | 4.0 | 3.0 | 7.7 | 12.7 | 12.8 | 11.5 | 6.6 |
| Example 2a | ThMn12 | Sm8Fe85Mo7 | 89.4 | Sm5(Fe0.95T0.05)17 | 3.6 | 4.0 | 7.0 | 7.9 | 12.0 | 14.1 | 10.9 | 7.2 |
| Example 3a | ThMn12 | Sm8Fe85V7 | 92.1 | Sm5(Fe0.95T0.05)17 | 3.9 | 4.0 | 4.0 | 7.8 | 12.3 | 13.6 | 11.1 | 7.0 |
| Example 4a | ThMn12 | Sm8Fe81Ti11 | 96.5 | Sm5(Fe0.95T0.05)17 | 3.5 | 4.0 | <1 | 7.7 | 10.5 | 13.3 | 6.5 | 6.8 |
| Example 5a | ThMn12 | Sm8Fe86Ti6 | 91.9 | Sm5(Fe0.95T0.05)17 | 4.1 | 4.0 | 4.0 | 7.7 | 13.1 | 12.3 | 11.9 | 6.3 |
| Example 6a | ThMn12 | Sm8Fe88Ti4 | 90.3 | Sm5(Fe0.95T0.05)17 | 3.7 | 4.0 | 6.0 | 7.7 | 13.3 | 11.4 | 12.0 | 5.9 |
| Example 7a | ThMn12 | Sm9Fe88Ti3 | 87.4 | Sm5(Fe0.95T0.05)17 | 3.6 | 4.0 | 9.0 | 7.7 | 13.2 | 10.8 | 12.0 | 5.6 |
| Comparative Example 51a | Th2Zn17 | Sm12Fe80Ti8 | 93.8 | Sm5(Fe0.95T0.05)17 | 4.2 | 4.0 | 2.0 | 7.7 | 6.3 | 1.1 | 5.7 | 0.6 |

TABLE 1-continued

| | Main Phase | | | Sub-Phase | | | | | | | | |
|---|---|---|---|---|---|---|---|---|---|---|---|---|
| | Crystal Structure | Composition | Volume Fraction (%) | Crystal Structure | Volume Fraction (%) | Mixed Amount of Alloy (mass %) | Volume Fraction of α-Fe Phase (%) | Density of Magnet (g/cm³) | 25° C. Br (kG) | 25° C. iHc (kOe) | 160° C. Br (kG) | 160° C. iHc (kOe) |
| Comparative Example 52a | ThMn12 | Sm5Fe88Ti9 | 72.3 | Sm5(Fe0.95T0.05)17 | 3.7 | 4.0 | 24.0 | 7.7 | 7.7 | 3.5 | 7.0 | 1.8 |
| Comparative Example 53a | Th2Zn17 | Sm8Fe92 | 96.2 | Sm5(Fe0.95T0.05)17 | 3.8 | 4.0 | <1 | 7.8 | 5.2 | 0.7 | 4.7 | 0.4 |
| Comparative Example 54a | ThMn12 | Sm8Fe85Ti7 | 93.0 | Sm5(Fe0.95T0.05)17 | 0 | 0 | 7.0 | 7.7 | 10.9 | 3.5 | 9.9 | 1.8 |

TABLE 2

| | Main Phase | | | Sub-Phase | | | | | | | | |
|---|---|---|---|---|---|---|---|---|---|---|---|---|
| | Crystal Structure | Composition | Volume Fraction (%) | Crystal Structure | Volume Fraction (%) | Mixed Amount of Alloy (mass %) | Volume Fraction of α-Fe Phase (%) | Density of Magnet (g/cm³) | 25° C. Br (kG) | 25° C. iHc (kOe) | 160° C. Br (kG) | 160° C. iHc (kOe) |
| Example 8a | ThMn12 | (Sm0.9Zr0.1) 8Fe86Ti6 | 91.3 | Sm(Co0.8Cu0.2)5 | 4.7 | 4.0 | 4.0 | 7.7 | 13.2 | 12.9 | 12.0 | 6.6 |
| Example 9a | ThMn12 | (Sm0.9Ce0.1) 8Fe86Ti6 | 91.8 | Sm(Co0.8Cu0.2)5 | 4.2 | 4.0 | 4.0 | 7.7 | 13.0 | 11.7 | 11.8 | 6.0 |
| Comparative Example 55a | ThMn12 | (Sm0.9Zr0.1) 8Fe86Ti6 | 93.0 | Sm(Co0.8Cu0.2)5 | 0 | 0 | 7.0 | 7.7 | 10.7 | 1.9 | 9.7 | 1.0 |

TABLE 3

| | Main Phase | | | Sub-Phase | | | | | | | | | |
|---|---|---|---|---|---|---|---|---|---|---|---|---|---|
| | Crystal Structure | Composition | Volume Fraction (%) | Crystal Structure | Volume Fraction (%) | Blended Amount of Alloy (mass %) | Applied Pressure (MPa) | Volume Fraction of α-Fe Phase (%) | Density of Magnet (g/cm³) | 25° C. Br (kG) | 25° C. iHc (kOe) | 160° C. Br (kG) | 160° C. iHc (kOe) |
| Example 10a | ThMn12 | (Sm0.9Zr0.1) 8Fe86Ti6 | 91.3 | Sm(Co0.8Cu0.2)5 | 4.7 | 4.0 | 400 | 4.0 | 7.5 | 13.1 | 13.5 | 11.9 | 6.9 |
| Example 11a | ThMn12 | (Sm0.9Zr0.1) 8Fe86Ti6 | 91.3 | Sm(Co0.8Cu0.2)5 | 4.7 | 4.0 | 100 | 4.0 | 7.0 | 12.8 | 13.1 | 11.6 | 6.7 |
| Comparative Example 56a | ThMn12 | (Sm0.9Zr0.1) 8Fe86Ti6 | 91.3 | Sm(Co0.8Cu0.2)5 | 4.7 | 4.0 | 0 | 4.0 | 5.7 | 10.8 | 9.2 | 9.8 | 4.7 |

TABLE 4

| | Main Phase | | | Sub-Phase | | |
|---|---|---|---|---|---|---|
| | Crystal Structure | Composition | Volume Fraction (%) | Crystal Structure | Volume Fraction (%) | Number of Times of Coatings |
| Example 1b | ThMn12 | (Sm0.875Zr0.125)8 (Fe0.77Co0.23)88Ti4 | 94.4 | Sm5(Fe0.95Ti0.05)17 | 2.6 | 1 |
| Example 2b | ThMn12 | (Sm0.875Zr0.125)8 (Fe0.77Co0.23)88Ti4 | 91.3 | Sm5(Fe0.95Ti0.05)17 | 5.2 | 3 |
| Example 3b | ThMn12 | (Sm0.875Zr0.125)8 (Fe0.77Co0.23)88Ti4 | 87.4 | Sm5(Fe0.95Ti0.05)17 | 9.5 | 5 |

TABLE 4-continued

| | | | | | | |
|---|---|---|---|---|---|---|
| Example 4b | ThMn12 | (Sm0.875Zr0.125)8 (Fe0.77Co0.23)88Ti4 | 91.8 | Sm(Co0.8Cu0.2)5 | 4.8 | 4 |
| Example 5b | ThMn12 | (Sm0.875Zr0.125)8 (Fe0.77Co0.23)88Ti4 | 94.2 | Sm0.7Cu0.3 | 2.7 | 2 |
| Example 6b | ThMn12 | (Sm0.875Zr0.125)8 (Fe0.77Co0.23)88Ti4 | 91.9 | Sm0.7Cu0.3 | 5.3 | 3 |
| Example 7b | ThMn12 | (Sm0.875Zr0.125)8 (Fe0.77Co0.23)88Ti4 | 88.9 | Sm203 | 7.8 | 4 |
| Comparative Example 51b | ThMn12 | (Sm0.875Zr0.125)8 (Fe0.77Co0.23)88Ti4 | 96.8 | Sm5(Fe0.95Ti0.05)17 | 0 | 0 |
| Comparative Example 52b | ThMn12 | (Sm0.875Zr0.125)8 (Fe0.77Co0.23)88Ti4 | 82.2 | Sm5(Fe0.95Ti0.05)17 | 15.2 | 8 |

| | Sub-Phase Converted Amount of Alloy (mass %) | Volume Fraction α-Fe Phase (%) | Density of Magnet (g/cm$^3$) | 25° C. Br (kG) | 25° C. iHc (kOe) | 160° C. Br (kG) | 160° C. iHc (kOe) |
|---|---|---|---|---|---|---|---|
| Example 1b | 2.0 | 3.0 | 7.7 | 14.2 | 11.2 | 13.4 | 6.4 |
| Example 2b | 5.0 | 3.5 | 7.7 | 14.4 | 13.2 | 13.6 | 7.5 |
| Example 3b | 9.0 | 3.1 | 7.7 | 13.6 | 15.4 | 12.8 | 8.7 |
| Example 4b | 5.0 | 3.4 | 7.7 | 14.1 | 12.7 | 13.3 | 7.2 |
| Example 5b | 2.0 | 3.1 | 7.7 | 13.8 | 12.1 | 13.0 | 6.9 |
| Example 6b | 5.0 | 2.8 | 7.7 | 13.6 | 11.6 | 12.8 | 6.6 |
| Example 7b | 5.0 | 3.3 | 7.7 | 13.7 | 10.7 | 12.9 | 6.1 |
| Comparative Example 51b | 0 | 3.2 | 7.7 | 10.8 | 1.3 | 10.2 | 0.7 |
| Comparative Example 52b | 15.0 | 2.6 | 7.7 | 11.7 | 16.3 | 11.1 | 9.3 |

TABLE 5

| | Main Phase | | | Sub-Phase | | |
|---|---|---|---|---|---|---|
| | Crystal Structure | Composition | Volume Fraction (%) | Crystal Structure | Volume Fraction (%) | Number of Times of Coatings (times) |
| Example 1c | ThMn12 | (Sm0.75(CeZr)0.25)8 (Fe0.77Co0.23)87Ti5 | 96.3 | Sm7Cu3 | 3.7 | 3 |
| Example 2c | ThMn12 | (Sm0.75(CeZr)0.25)8 (Fe0.77Co0.23)87Ti5 | 94.9 | Sm7Cu3 | 5.1 | 3 |
| Example 3c | ThMn12 | (Sm0.75(CeZr)0.25)8 (Fe0.77Co0.23)87Ti5 | 94.8 | Sm7Cu3 | 5.2 | 3 |
| Example 4c | ThMn12 | (Sm0.75(CeZr)0.25)8 (Fe0.77Co0.23)87Ti5 | 94.7 | Sm7Cu3 | 5.3 | 3 |
| Comparative Example 51c | ThMn12 | (Sm0.75(CeZr)0.25)8 (Fe0.77Co0.23)87Ti5 | 100 | Sm7Cu3 | 0 | 3 |
| Comparative Example 52c | ThMn12 | (Sm0.75(CeZr)0.25)8 (Fe0.77Co0.23)87Ti5 | 99.2 | Sm7Cu3 | 0.8 | 3 |

| | Sub-Phase Converted Amount of Alloy (mass %) | Heat Treatment Temperature (° C.) | Volume Fraction of α-Fe Phase (%) | Density of Magnet (g/cm$^3$) | 25° C. Br (kG) | 25° C. iHc (kOe) | 160° C. Br (kG) | 160° C. iHc (kOe) |
|---|---|---|---|---|---|---|---|---|
| Example 1c | 5.0 | 600 | — | 7.7 | 13.5 | 10.5 | 12.8 | 6.0 |
| Example 2c | 5.0 | 700 | — | 7.7 | 13.4 | 13.7 | 12.7 | 7.8 |
| Example 3c | 5.0 | 800 | — | 7.7 | 13.4 | 13.3 | 12.7 | 7.6 |
| Example 4c | 5.0 | 900 | — | 7.7 | 13.2 | 12.5 | 12.5 | 7.1 |
| Comparative Example 51c | 0 | slurry was not applied | — | 7.7 | 9.4 | 1.2 | 8.9 | 0.7 |
| Comparative Example 52c | 5.0 | 500 | — | 7.7 | 9.8 | 1.7 | 9.3 | 1.0 |

Note)
In Volume Fraction of α-Fe Phase, "—" indicates that the volume fraction of α-Fe phase is small to an unmeasurable extent.

TABLE 6

| | Main Phase | | | Sub-Phase | | |
|---|---|---|---|---|---|---|
| | Crystal Structure | Composition | Volume Fraction (%) | Crystal Structure | Volume Fraction (%) | Number of Times of Coatings (times) |
| Example 5c | ThMn12 | (Sm0.75(CeZr)0.25)8 (Fe0.77Co0.23)87Ti5 | 97.7 | Sm5(Fe0.95Ti0.05)17 | 2.3 | 3 |
| Example 6c | ThMn12 | (Sm0.75(CeZr)0.25)8 (Fe0.77Co0.23)87Ti5 | 96.3 | Sm5(Fe0.95Ti0.05)17 | 3.7 | 3 |
| Example 7c | ThMn12 | (Sm0.75(CeZr)0.25)8 (Fe0.77Co0.23)87Ti5 | 94.9 | Sm5(Fe0.95Ti0.05)17 | 5.1 | 3 |
| Example 8c | ThMn12 | (Sm0.75(CeZr)0.25)8 (Fe0.77Co0.23)87Ti5 | 95.3 | Sm5(Fe0.95Ti0.05)17 | 4.7 | 3 |
| Example 9c | ThMn12 | (Sm0.75(CeZr)0.25)8 (Fe0.77Co0.23)87Ti5 | 97.4 | Sm5(Fe0.95Ti0.05)17 | 2.6 | 3 |
| Comparative Example 53c | ThMn12 | (Sm0.75(CeZr)0.25)8 (Fe0.77Co0.23)87Ti5 | 100 | Sm5(Fe0.95Ti0.05)17 | 0 | 3 |
| Comparative Example 54c | ThMn12 ThMh10 | (Sm0.75(CeZr)0.25)8 (Fe0.77Co0.23)87Ti5 | 98.9 | Sm5(Fe0.95Ti0.05)17 | 1.1 | 3 |

| | Sub-Phase Converted Amount of Alloy (mass %) | Heat Treatment Temperature (° C.) | Volume Fraction of α-Fe Phase (%) | Density of Magnet (g/cm³) | 25° C. Br (kG) | 25° C. iHc (kOe) | 160° C. Br (kG) | 160° C. iHc (kOe) |
|---|---|---|---|---|---|---|---|---|
| Example 5c | 5.0 | 500 | — | 7.7 | 13.5 | 10.2 | 12.8 | 5.8 |
| Example 6c | 5.0 | 600 | — | 7.7 | 13.7 | 11.5 | 12.9 | 6.5 |
| Example 7c | 5.0 | 700 | — | 7.7 | 13.7 | 12.7 | 12.9 | 7.2 |
| Example 8c | 5.0 | 800 | — | 7.7 | 13.6 | 12.4 | 12.8 | 7.0 |
| Example 9c | 5.0 | 900 | — | 7.7 | 13.4 | 11.3 | 12.7 | 6.4 |
| Comparative Example 53c | 0 | slurry was not applied | — | 7.7 | 9.4 | 1.2 | 8.9 | 0.7 |
| Comparative Example 54c | 5.0 | 1000 | — | 7.7 | 13.0 | 7.4 | 12.3 | 4.2 |

Note)

In Volume Fraction of α-Fe Phase, "—" indicates that the volume fraction of α-Fe phase is small to an unmeasurable extent.

TABLE 7

| | Main Phase | | | | Sub-Phase | |
|---|---|---|---|---|---|---|
| | Crystal Structure | Composition | Replacement Ratio by Co | Volume Fraction (%) | Crystal Structure | Volume Fraction (%) |
| Example 1d | ThMn12 | (Sm0.875Zr0.125) 8Fe88Ti4 | 0 | 91.3 | Sm5(Fe0.95Ti0.05)17 | 5.2 |
| Example 2d | ThMn12 | (Sm0.875Zr0.125)8 (Fe0.9Co0.1)88Ti4 | 0.1 | 91.3 | Sm5(Fe0.95Ti0.05)17 | 5.2 |
| Example 3d | ThMn12 | (Sm0.875Zr0.125)8 (Fe0.8Co0.2)88Ti4 | 0.2 | 91.3 | Sm5(Fe0.95Ti0.05)17 | 5.2 |
| Example 4d | ThMn12 | (Sm0.875Zr0.125)8 (Fe0.7Co0.3)88Ti4 | 0.3 | 91.3 | Sm5(Fe0.95Ti0.05)17 | 5.2 |
| Example 5d | ThMn12 | (Sm0.875Zr0.125)8 (Fe0.5Co0.5)88Ti4 | 0.5 | 91.3 | Sm5(Fe0.95Ti0.05)17 | 5.2 |
| Example 6d | ThMn12 | (Sm0.875Zr0.125)8 (Fe0.3Co0.7)88Ti4 | 0.7 | 91.3 | Sm5(Fe0.95Ti0.05)17 | 5.2 |
| Example 7d | ThMn12 | (Sm0.875Zr0.125)8 (Fe0.2Co0.8)88Ti4 | 0.8 | 91.3 | Sm5(Fe0.95Ti0.05)17 | 5.2 |
| Reference Example 51d | | Nd2Fe14B | | | Nd | |

TABLE 7-continued

| | Sub-Phase | | Volume | | | | | |
|---|---|---|---|---|---|---|---|---|
| | Number of Times of Coatings (times) | Converted Amount of Alloy (mass %) | Fraction of α-Fe Phase (%) | Density of Magnet (g/cm³) | 25° C. Br (kG) | 25° C. iHc (kOe) | 160° C. Br (kG) | 160° C. iHc (kOe) |
| Example 1d | 3 | 5.0 | 3.5 | 7.7 | 12.4 | 13.5 | 11.2 | 6.9 |
| Example 2d | 3 | 5.0 | 3.5 | 7.7 | 13.2 | 13.2 | 12.3 | 7.0 |
| Example 3d | 3 | 5.0 | 3.5 | 7.7 | 13.8 | 13.1 | 13.0 | 7.4 |
| Example 4d | 3 | 5.0 | 3.5 | 7.7 | 14.0 | 13.1 | 13.4 | 7.3 |
| Example 5d | 3 | 5.0 | 3.5 | 7.7 | 13.3 | 12.5 | 12.8 | 7.4 |
| Example 6d | 3 | 5.0 | 3.5 | 7.7 | 12.2 | 10.3 | 11.8 | 6.4 |
| Example 7d | 3 | 5.0 | 3.5 | 7.7 | 11.6 | 8.7 | 11.2 | 5.4 |
| Reference Example 51d | 3 | | | 7.6 | 13.5 | 19.8 | 10.7 | 5.1 |

Note)
In Volume Fraction of α-Fe Phase, "—" indicates that the volume fraction of α-Fe phase is small to an unmeasurable extent.

Figure 4:
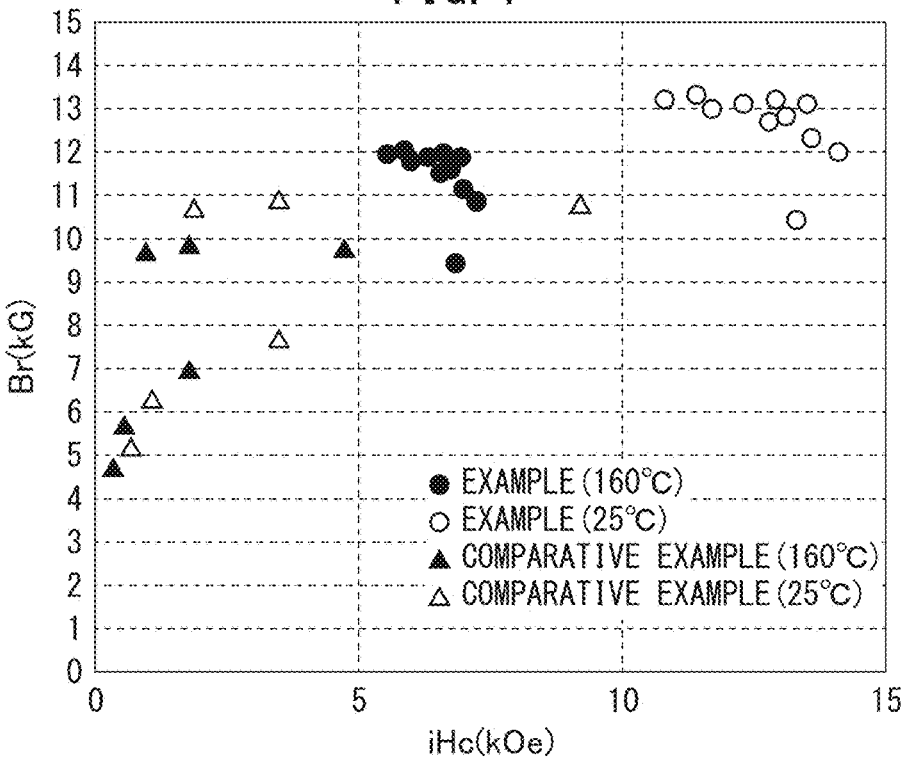

The results of Tables 1 to 3 are graphically summarized in FIG. 4. That is, FIG. 4 is a graph illustrating the relationship of iHc and Br at 25° C. and 160° C. in rare earth magnets of Examples 1a to 11a and Comparative Examples 51a to 56a.

Figure 5:
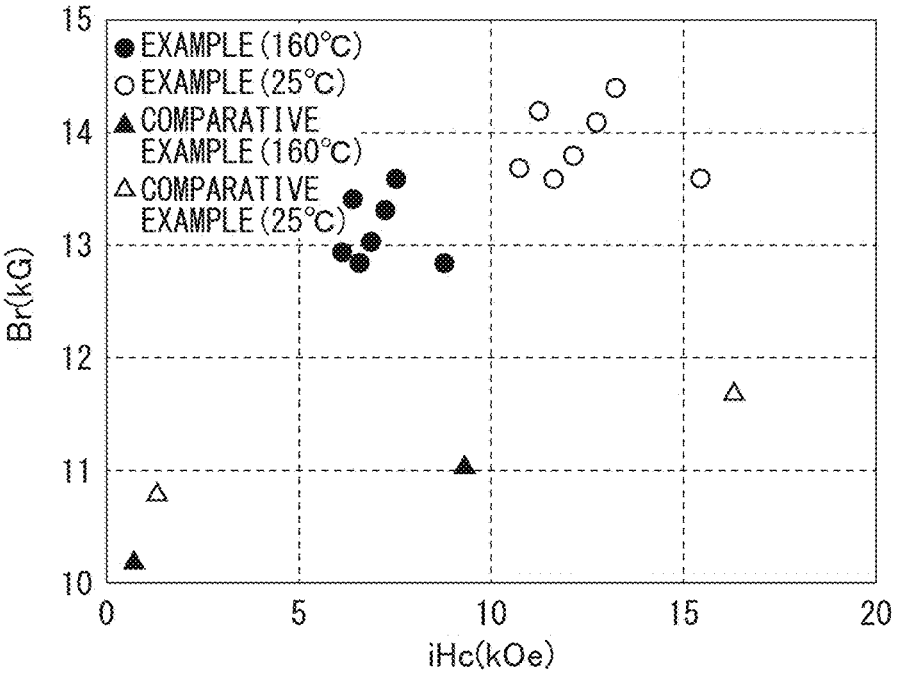
FIG. 5 A graph illustrating the relationship of iHc and Br at 25° C. and 160° C. in rare earth magnets of Examples 1b to 17b and Comparative Examples 51b and 52b.

The results of Table 4 are graphically summarized in FIG. 5. That is, FIG. 5 is a graph illustrating the relationship of iHc and Br at 25° C. and 160° C. in rare earth magnets of Examples 1b to 17b and Comparative Examples 51b and 52b.

Figure 6:
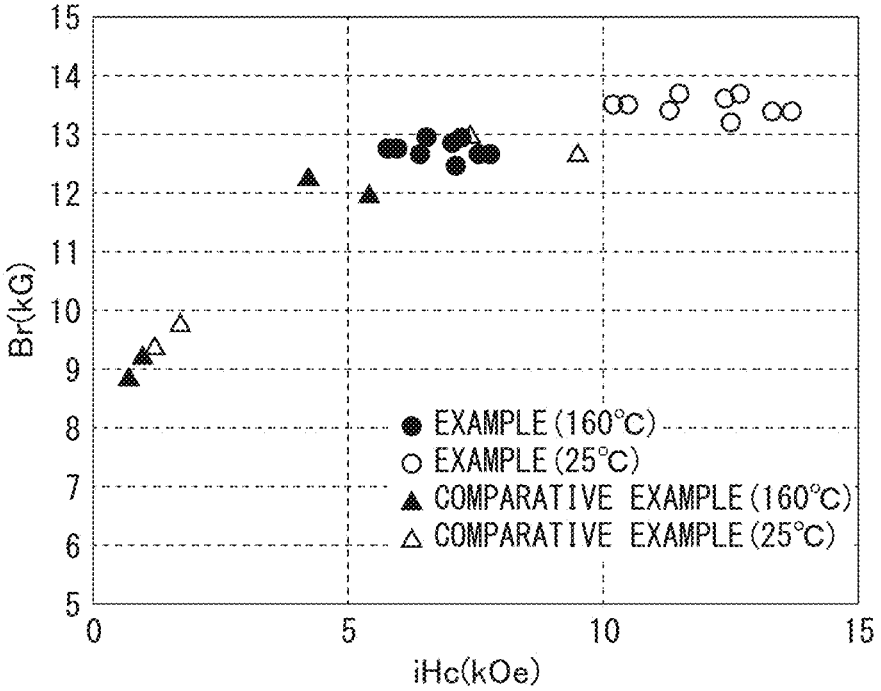
FIG. 6 A graph illustrating the relationship of iHc and Br at 25° C. and 160° C. in rare earth magnets of Examples 1c to 9c and Comparative Examples 51c to 54c.

The results of Tables 5 and 6 are graphically summarized in FIG. 6. That is, FIG. 6 is a graph illustrating the relationship of iHc and Br at 25° C. and 160° C. in rare earth magnets of Examples 1c to 9c and Comparative Examples 51c to 55c.

Figure 7:
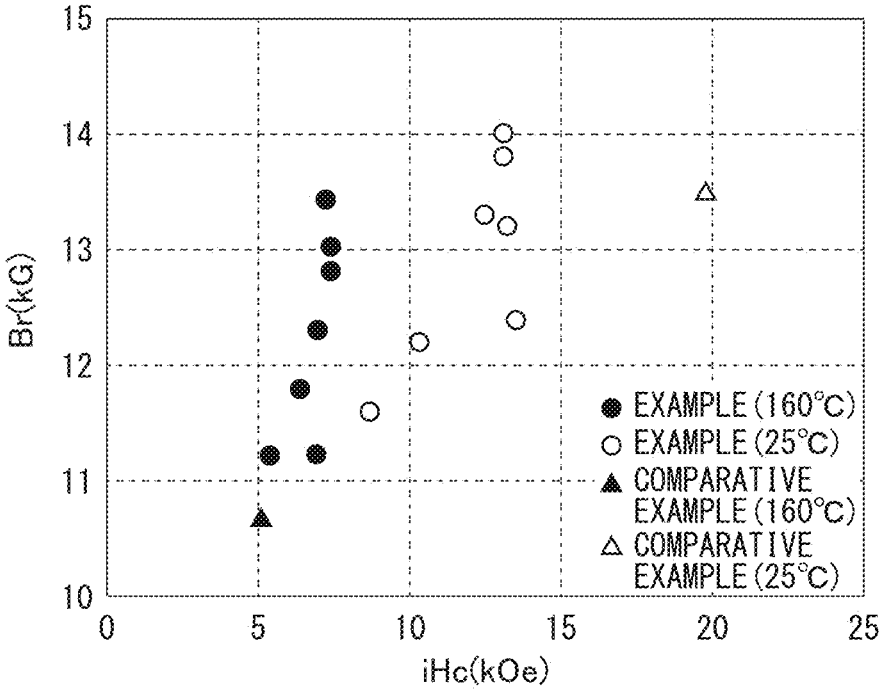
FIG. 7 A graph illustrating the relationship of iHc and Br at 25° C. and 160° C. in rare earth magnets of Examples 1d to 7d and Reference Example 51d.

The results of Table 7 are graphically summarized in FIG. 7. That is, FIG. 7 is a graph illustrating the relationship of iHc and Br at 25° C. and 160° C. in rare earth magnets of Examples 1d to 9d and Reference Example 51d.

In Tables 1 to 3 and FIG. 4, the evaluation results of rare earth magnets prepared by the production method of the first embodiment (a production method of mixing and sintering a first alloy powder and a second alloy powder) are shown together.

As shown in Tables 1 to 3 and FIG. 4, in the rare earth magnets of Examples 1a to 11a, Br and iHc at a high temperature as well as at room temperature are enhanced. It was also confirmed by scanning electron microscope observation that in Examples 1a to 11a, the thickness of the main phase of the rare earth magnet is from 0.2 to 20 μm.

On the other hand, in Comparative Examples 51a to 54a, enhancement of Br and/or iHc was not recognized at room temperature and/or a high temperature for the following reasons. In Comparative Example 51a, the Sm content is excessive, and the main phase does not have a $ThMn_{12}$-type crystal structure. In Comparative Example 52a, the Ti content is excessive, and the volume fraction of an α-Fe phase is large. In Comparative Example 53a, Ti is not contained, as a result, the main phase does not have a $ThMn_{12}$-type crystal structure. In Comparative Example 54d, a sub-phase is not contained and consequently, enhancement of Br and iHc at room temperature and a high temperature was not recognized.

In Table 4 and FIG. 5, the evaluation results of rare earth magnets prepared by the production method of the third embodiment (a production method of applying a second alloy powder slurry onto the sintered body and heating the sintered body) are shown together. Table 4 and FIG. 5 include also the evaluation results of rare earth magnets prepared by the production method of the fourth embodiment (a method of applying, in place of a second alloy powder, a metal oxide slurry onto the sintered body).

As shown in Table 4 and FIG. 5, in the rare earth magnets of Examples 1b to 7b, Br and iHc at a high temperature as well as at room temperature are enhanced.

On the other hand, in Comparative Example 51b, since a second alloy powder slurry was not applied, a sub-phase was not developed, and enhancement of Br and iHc at room temperature and a high temperature was not recognized. In Comparative Example 52b, since a second alloy powder slurry was excessively applied, the volume fraction of the sub-phase was excessive or enhancement of Br at room temperature and a high temperature was not recognized.

In Tables 5 and 6 and FIG. 6, the evaluation results of rare earth magnets prepared by the production method of the third embodiment (a production method of applying a second alloy powder slurry onto the sintered body and heating the sintered body) are shown together. At the time of preparation of the rare earth magnet, the heating temperature of the coated sintered body (sintered body after coating with slurry) is changed.

As shown in Tables 5 and 6 and FIG. 6, in the rare earth magnets of Examples 1c to 9c, Br and iHc at a high temperature as well as at room temperature are enhanced.

On the other hand, in Comparative Examples 51c and 53c, since a second alloy powder slurry was not applied, a sub-phase was not developed, and enhancement of Br and iHc, particularly iHc, at room temperature and a high temperature was not recognized. In Comparative Example 52c, since the heating temperature after applying the slurry onto the sintered body was too low, the volume fraction of the sub-phase was insufficient, as a result, enhancement of Br and iHc, particularly iHc, at room temperature and a high temperature was not recognized. The main phase does not have a $ThMn_{12}$-type crystal structure. In Comparative Example 54c, since the heating temperature of the coated sintered body (sintered body after coating with slurry) was too high, the sub-phase was decomposed, leading to an insufficient volume fraction of the sub-phase, and in particular, iHc at a high temperature was not enhanced.

In Table 7 and FIG. 7, the evaluation results of rare earth magnets prepared by the production method of the third embodiment (a production method of applying a second alloy powder slurry onto the sintered body and heating the sintered body) are shown together. At the time of preparation of the rare earth magnet, the Co content in the main phase is changed. Reference Example 51d shows the results of an Nd—Fe—B-based magnet.

As shown in Table 7 and FIG. 7, in the Nd—Fe—B-based magnet, iHc at a high temperature is significantly reduced. On the other hand, in the rare earth magnets of Examples 1d to 6d where the main phase has a $ThMn_{12}$-type crystal structure, Br and iHc at room temperature and a high temperature are reduced depending on the Co content in the main phase 10. However, in the rare earth magnets of Examples 1d to 6d, when the replacement ratio y by Co is from 0 to 0.8, iHc at a high temperature is better than in the Nd—Fe-b-based magnet.

The effects of the present invention could be confirmed from these results.

DESCRIPTION OF NUMERICAL REFERENCES

10 Main phase
20, 50 Sub-phase
60 SmCu Phase
70 Sm Phase
100 Rare earth magnet of the present invention
500 Conventional rare earth magnet

The invention claimed is:

1. A rare earth magnet comprising a main phase and a sub-phase, wherein the main phase has a $ThMn_{12}$-type crystal structure, wherein the sub-phase contains at least any one of an $Sm_5Fe_{17}$-based phase, an $SmCo_5$-based phase, an $Sm_2O_3$-based phase, and an $Sm_7Cu_3$-based phase, wherein the volume fraction of the sub-phase is from 2.3 to 9.5% and the volume fraction of an α-Fe phase is 9.0% or less, when the volume of the rare earth magnet is 100%, and wherein the density of the rare earth magnet is 7.0 g/cm$^3$ or more.

2. The rare earth magnet according to claim 1, wherein part of Fe of the $Sm_5Fe_{17}$-based phase is replaced by Ti.

3. The rare earth magnet according to claim 2, wherein the $Sm_5Fe_{17}$-based phase contains an $Sm_5(Fe_{0.95}Ti_{0.05})_{17}$ phase.

4. The rare earth magnet according to claim 1, wherein part of Co of the $SmCo_5$-based phase is replaced by Cu.

5. The rare earth magnet according to claim 4, wherein the $SmCo_5$-based phase contains an $Sm(Co_{0.3}Cu_{0.2})_5$ phase.

6. The rare earth magnet according to claim 1, wherein the composition of the main phase is represented by the formula:

$$(R^1_{(1-x)}R^2_x)_a(Fe_{(1-y)}Co_y)_bT_cM_d$$

(wherein $R^1$ is one or more rare earth elements selected from the group consisting of Sm, Pm, Er, Tm and Yb, $R^2$ is one or more elements selected from the group consisting of Zr, La, Ce, Pr, Nd, Eu, Gd, Tb, Dy, Ho and Lu, T is one or more elements selected from the group consisting of Ti, V, Mo, Si, Al, Cr and W, M is one or more elements selected from the group consisting of Cu, Ga, Ag and Au, and unavoidable impurity elements, $0 \le x \le 0.5$, $0 \le y \le 0.8$, $4.0 \le a \le 9.0$, $b = 100 - a - c - d$, $3.0 \le c \le 7.0$, and $0 \le d \le 3.0$).

7. The rare earth magnet according to claim 1, wherein the $Sm_5Fe_{17}$-phase, the $SmCo_5$-phase, the $Sm_2O_3$-phase, and the $Sm_7Cu_3$-phase contain an $Sm_5Fe_{17}$ phase, an $SmCo_5$ phase, an $Sm_2O_3$ phase, and an $Sm_7Cu_3$ phase, respectively.

8. The rare earth magnet according to claim 7, wherein the $Sm_7Cu_3$-based phase contains a phase having mixed therein an Sm phase and an SmCu phase in a ratio of 3:4.

9. The rare earth magnet according to claim 8, wherein the Sm phase contains a crystal phase and an amorphous Sm phase.

* * * * *